US008923735B2

(12) United States Patent
Yamashita et al.

(10) Patent No.: US 8,923,735 B2
(45) Date of Patent: Dec. 30, 2014

(54) TONER BEARING MEMBER INCLUDING SURFACE LAYER CONTAINING CROSSLINK REACTION PRODUCT OF FLUORORESIN AND/OR (METH)ACRYLATE COMPOUND, DEVELOPING DEVICE, AND IMAGE FORMING APPARATUS

(75) Inventors: Yasuyuki Yamashita, Kanagawa (JP); Shohei Gohda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 13/608,923

(22) Filed: Sep. 10, 2012

(65) Prior Publication Data

US 2013/0064578 A1 Mar. 14, 2013

(30) Foreign Application Priority Data

Sep. 14, 2011 (JP) ..... 2011-200820

(51) Int. Cl.
*G03G 15/08* (2006.01)

(52) U.S. Cl.
CPC ..... *G03G 15/0818* (2013.01)
USPC ..... 399/266; 399/279; 399/286

(58) Field of Classification Search
CPC ..... G03G 15/0803; G03G 15/0818; G03G 2215/0621; G03G 2215/0651; G03G 2215/0656
USPC ..... 399/266, 279, 286
See application file for complete search history.

(56) References Cited

U.S. PATENT DOCUMENTS

| | | | | |
|---|---|---|---|---|
| 7,907,856 | B2 * | 3/2011 | Tsukamoto et al. | 399/266 |
| 8,369,755 | B2 * | 2/2013 | Osaka et al. | 399/286 |
| 8,606,150 | B2 * | 12/2013 | Yamashita et al. | 399/239 |
| 2008/0124138 | A1 | 5/2008 | Kosugi et al. | |
| 2010/0303509 | A1 | 12/2010 | Yamashita et al. | |

FOREIGN PATENT DOCUMENTS

| | | |
|---|---|---|
| CN | 101002146 | 7/2007 |
| JP | 3-21967 | 1/1991 |
| JP | 2002-302251 | 10/2002 |
| JP | 2007-133387 | 5/2007 |
| JP | 2007-133388 | 5/2007 |
| JP | 2007-233199 | 9/2007 |
| JP | 2008-8929 | 1/2008 |
| JP | 2009-3314 | 1/2009 |
| JP | 2009-157096 | 7/2009 |
| JP | 2010-39354 | 2/2010 |
| JP | 2010-281859 | 12/2010 |

OTHER PUBLICATIONS

Chinese official action dated Jun. 30, 2014 (and English translation) in corresponding Chinese patent application No. 2012 10 34 2533.9.

* cited by examiner

*Primary Examiner* — William J Royer
(74) *Attorney, Agent, or Firm* — Cooper & Dunham LLP

(57) ABSTRACT

A toner hearing member includes: an electric conductive support; an insulating layer provided on the electric conductive support; a plurality of electrodes located on the insulating layer so that each electrode is separated from one another with a certain space; and a surface layer covering the insulating layer and the electrodes, wherein the surface layer contains a crosslink reaction product of a fluororesin, or a crosslink reaction product of a (meth)acrylate compound, or both thereof.

11 Claims, 4 Drawing Sheets

TONER BEARING MEMBER INCLUDING SURFACE LAYER CONTAINING CROSSLINK REACTION PRODUCT OF FLUORORESIN AND/OR (METH)ACRYLATE COMPOUND, DEVELOPING DEVICE, AND IMAGE FORMING APPARATUS

BACKGROUND OF THE INVENTION

1. Field of the Invention

The present invention relates to a toner bearing member, a developing device having the toner bearing member, and an image forming apparatus equipped with the developing device.

2. Description of the Related Art

A developing device employing an electrophotographic process is used in an image forming apparatus, such as a photocopier, printer, and facsimile Among such developing devices, a non-contact type developing device has attracted attention where the non-contact type developing device performs developing without contacting a toner bearing member, which transport a developer (a toner), with a photoconductor on which a latent electrostatic image is formed. As for the non-contact developing system, known are developing methods utilizing a powder round system, a jumping system, or an electric field curtain system.

The jumping system is a system where the toner is made to jump between the photoconductor to the toner hearing member, and requires an applied voltage that is equal to or stronger than the adhesion between the toner and the surface of the toner bearing member.

The electric field curtain system is to supply a toner to a latent electrostatic image by applying an alternative electric field to a plurality of electrode provided and aligned with a certain pitch in a toner bearing member, and making the previously charged toner hop by the electric field curtain formed by alternating a non-uniform electric field formed on the surface of the toner bearing member. Since the toner hops at the surface of the toner bearing member, the adhesion between the toner and the toner bearing member becomes almost nil. A force for separating the toner from the surface of the toner hearing member for developing is not necessary, and therefore, the toner can be sufficiently transported to the side of the photoconductor with application of a low voltage.

For example, in the case where a toner bearing member, in which a plurality of electrode are covered with a surface protective layer formed of an insulating material, is used in a developing device of an electric field curtain system, an electric charge of the toner does not leak to the electrode, and hopping failures, which may occur because of loss of electric charge of the toner, do not occur (see Japanese Patent Application Laid-Open (JP-A) No. 03-21967).

Moreover, proposed is to form a surface of a toner bearing member with a material accelerating frictional electrification to a regular charge polarity of the toner, for supplying a toner to a surface of the toner bearing member without frictional electrification of the toner in advance, and making the toner hop with an alternating electric field to thereby charge the toner (see JP-A No. 2007-133388).

Moreover, proposed are a toner bearing member using bisphenol Z polycarbonate in a surface layer thereof, a developing device equipped with the toner bearing member, and an image forming apparatus equipped with the toner bearing member (see JP-A No. 2010-281859). In this proposal, however, the surface layer of the toner bearing member is abraded and the electrode is exposed, as a number of fed sheets increases, which causes leaking. The toner bearing member causing leaking leaves a leak mark, and at a surface of which toner hopping cannot be formed regularly. If an image is output in such a state, a defected image having a defected portion in which a toner density is low is formed.

Accordingly, it is desired to form a surface layer of a toner bearing member with a material having abrasion resistance in order to stably perform image formation over a long period. Moreover, the material of the surface layer is also required to have an appropriate toner charging ability. Although a surface layer is formed with an insulating material or a material accelerating frictional electrification to the regular charge polarity of the toner, a strong electrostatic attractive force is generated between the toner and the surface layer of the toner bearing member, if electrification of the toner and that of the surface of the toner are too strong. This attractive force overcomes the powder of the toner to hop by receiving the electric field from the electrode inside the toner bearing member, and therefore the toner continues to adhere to the surface of the toner bearing member, and does not hop. The toner cannot be charged unless the toner is sufficiently hopped, and moreover a toner cloud is not formed, which lead to formation of a defected image.

Here, "toner cloud" means that the toner is floated in the air in the form of a mist by intermittently repeating hopping of the toner.

Even when a toner cloud is formed and a regular image can be output at an initial stage, a balance between an attractive force of the toner to the toner bearing member and toner hopping is easily destroyed, as a number of the fed sheets increases, due to a change in the electric field from the electrode inside the toner bearing member caused by abrasion of the surface layer of the toner bearing member, a change in electrostatic charge of the toner caused by a change in an amount of the toner transported to the toner bearing member as a result of a change in the surface condition (roughness) of the surface layer, and a change in tackiness of the toner bearing member to the toner (attractive force of the toner bearing member to the toner). As a result, the toner is adhered to the surface of the toner bearing member, and therefore the toner does not sufficiently hop even when the toner receives the electric field from the electrode inside the toner bearing member, which reduces output image density. Therefore, it is extremely difficult to output regular images after feeding, as output image density is low.

Accordingly, there is currently a need for a toner bearing member whose surface layer is formed of a material having a toner charging ability capable of providing a toner with electric charge that sufficiently induce toner hopping, and having high abrasion resistance, and which can prevent output of a defected image by achieving the aforementioned properties, as well as needs for a developing device having the toner bearing member, and an image forming apparatus equipped with the developing device.

SUMMARY OF THE INVENTION

The present invention aims to solve various problems in the art, and to achieve the following object. Specifically, an object of the present invention is to provide a toner bearing member, which has appropriate toner electrostatic property and high durability of a surface layer, is capable of stably forming a toner cloud over a long period, and can supply the toner to a latent electrostatic image on a surface of a photoconductor to develop the latent electrostatic image, as well as providing a developing device containing the toner bearing member, and an image forming apparatus equipped with the developing device.

The means for solving the problems are as follows:

A toner bearing member, containing:

an electric conductive support;

an insulating layer provided on the electric conductive support;

a plurality of electrodes located on the insulating layer so that each electrode is separated from one another with a certain space; and a surface layer covering the insulating layer and the electrodes, wherein the surface layer contains a crosslink reaction product of a fluororesin, or a crosslink reaction product of a (meth)acrylate compound, or both thereof.

In the toner bearing member of the present invention, the surface layer contains a crosslink reaction product of a fluororesin, a crosslink reaction product of a (meth)acrylate compound, or both thereof, and therefore the surface layer achieves an appropriate toner charging ability and high durability, can stably form a toner cloud over a long period, and can supply the toner to a surface of a photoconductor to develop a latent electrostatic image.

Even with a toner bearing member used for a developing device of a non-contact system, a toner supply roller and toner regulating member are physically brought into contact with a surface of the toner bearing member, and as a result, a surface layer of the toner bearing member is abraded. Moreover, the abrasion of the surface of the toner bearing member is caused by repeated discharge performed when a surface of the toner bearing member is diselectrified by means of the toner supply roller. As in the conventional art, when a polycarbonate resin, which is a non-curing resin, is used in a surface layer (98) of a toner bearing member (9), the polycarbonate resin (P) is cut (c) into segments of low molecular weights, as illustrated in FIGS. 1A, 1B and 1C, by repeated discharge (X) by a toner supply roller (12). Polycarbonate molecule (L) of low molecular weight is easily scraped by a rub with a contact member, such as a toner regulating member (11), to thereby reduce a thickness of a surface layer of the toner bearing member (9).

In the toner bearing member of the present invention, the surface layer contains a crosslink reaction product of a fluororesin, a crosslink reaction product of a (meth)acrylate compound, or both thereof, and therefore abrasion resistance increases, as a polymer structure thereof is maintained with the crosslink structure even when the polymer constituting the crosslink reaction product may be partially cut due to repeated discharge from the toner supply roller. Accordingly, an appropriate toner charging ability and high durability of the surface layer is maintained over a long period.

The present invention can solve the various problems in the art, achieve the aforementioned object, and provide a toner bearing member, which has appropriate toner electrostatic property and high durability of a surface layer, is capable of stably forming a toner cloud over a long period, and can supply the toner to a latent electrostatic image on a surface of a photoconductor to develop a latent electrostatic image, as well as providing a developing device containing the toner bearing member, and an image forming apparatus equipped with the developing device.

Figure 1A:
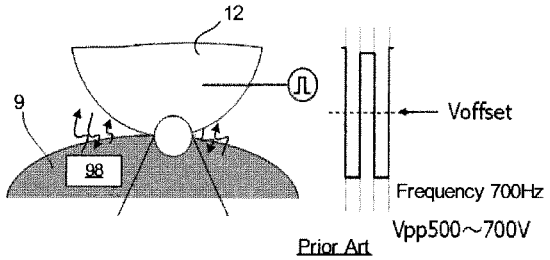
FIG. 1A is a diagram for explaining a mechanism how abrasion of a surface layer of the toner bearing member occurs.
Figure 1B:
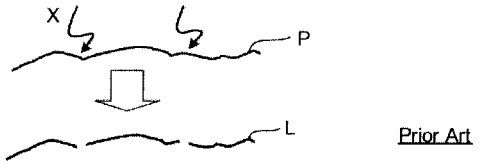
FIG. 1B is a diagram for explaining a mechanism how abrasion of a surface layer of the toner bearing member occurs, and a partially enlarged view of FIG. 1A.
Figure 1C:
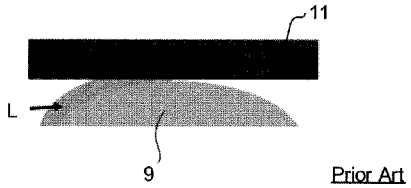
FIG. 1C is a diagram for explaining a mechanism how abrasion of a surface layer of the toner bearing member occurs.

DETAILED DESCRIPTION OF THE INVENTION (Toner Bearing Member)

A toner bearing member of the present invention contains an electric conductive support, an insulating layer provided on the electric conductive support, a plurality of electrodes located on the insulating layer so that each electrode is separated from one another with a certain space, and a surface layer covering the insulating layer and the electrodes, and may further contain other members, if necessary.

<Electric Conductive Support>

A material, shape, structure, and size of the electric conductive support is appropriately selected depending on the intended purpose without any limitation, provided that the electric conductive support exhibits electric conductivity that is the volume resistivity of $10^{10}$ Ω·cm or lower.

Examples of the shape of the electric conductive support include a pillar shape, a cylindrical shape, and a film shape. The size of the electric conductive support is appropriately selected depending on the intended purpose without any limitation, but it is preferably a size which is typically used.

Examples of the electric conductive support include: a support formed or a metal (e.g., Al, Ni, Fe, Cu, and Au) or alloy thereof, a support prepared by forming an electric conductive material (e.g., a metal such as Al, Ag, and Au; and metal oxide such as $In_2O_3$, and $SnO_2$) into a thin film on an insulating substrate, such as polyester, polycarbonate, polyimide, and glass; a support in which electric conductivity is imparted to a resin by uniformly dispersing a metal powder (e.g., carbon black, graphite, aluminum, copper, and nickel) or an electric conductive glass powder into the resin; and paper subjected to an electric conductive treatment.

<Insulating Layer>

The power consumption when alternating voltage is applied between the electric conductive support and the electrode is proportional to dielectric constant of the insulating layer. Therefore, the dielectric constant of the insulating layer is preferably small. Moreover, the insulating layer is required to have such insulation property that alternating voltage applied to the electrode does not leak to the electric conductive support, and to have such properties that an electrode and a surface layer can be formed on the insulating layer.

The insulating layer exhibits insulation properties that the volume resistivity is $10^{13}$ Ω·cm or higher.

The insulating layer contains at least a resin, and may further contain other components, if necessary.

—Resin—

The resin is appropriately selected depending on the intended purpose without any limitation, provided that it is not dissolved in a solvent contained in a surface layer coating liquid. Examples of the resin include: a water-soluble resin such as polyvinyl alcohol, casein, and sodium polyacrylate; an alcohol-soluble resin, such as copolymer nylon, and methoxymethylated nylon; a curable resin that forms a three-dimensional network structure, such as polyurethane, a melamine resin, an alkyd-melamine resin, and an epoxy resin; and a crosslink reaction product of a fluororesin. These may be used independently, or in combination.

Among them, a crosslink reaction product of a fluororesin is particularly preferable, in view of low powder consumption of a resulting toner bearing member.

The crosslink reaction product of the fluororesin contains a fluororesin, and may further contain a curing agent, and appropriately selected other components, if necessary.

The fluororesin is appropriately selected depending on the intended purpose without any limitation, but it is particularly preferably a copolymer of fluoroethylene and a vinyl ether monomer.

Examples of the fluoroethylene include tetrafluoroethylene, and chlorotrifluoroethylene.

Examples of the vinyl ether monomer include: cycloalkyl vinyl ether, such as cyclohexyl vinyl ether, and alkyl vinyl ether, such as ethyl vinyl ether, n-propyl vinyl ether, propyl vinyl ether, n-butyl vinyl ether, i-butyl vinyl ether, t-butyl vinyl ether, hexyl vinyl ether, 2-ethylhexyl vinyl ether, nonyl vinyl ether, fluoroalkyl vinyl ether, and perfluoro(alkyl vinyl ether).

—Other Components—

Examples of other components include additives, such as various plasticizers and leveling agents.

The insulating layer can be formed by preparing an insulating layer coating liquid in which the resin is dissolved in a solvent such as methyl ethyl ketone, and applying the insulating layer coating liquid onto the electric conductive support by dip coating, or spray coating.

The average thickness of the insulating layer is appropriately selected depending on a material of the insulating layer without any limitation, but it is preferably 1 μm to 100 μm, more preferably 1 μm to 50 μm. When the average thickness thereof is less than 1 μm, it may be difficult to provide the insulating layer with insulation properties that prevent occurrence of charge leak between the electrode and the toner. When the average thickness thereof is greater than 100 μm, the electric field from the electrode becomes weak, which makes it difficult to generate electrostatic force capable of causing hopping of a toner, which is detached from a surface layer.

<Electrode>

A size, shape, structure, and material of the electrode are appropriately selected depending on the intended purpose without any limitation.

Examples of the material thereof include; a metal, such as platinum, gold, silver, nickel, chromium, copper, iron, zinc, tin, tantalum, aluminum, indium, and tungsten; oxide, such as antimony tin oxide (ATO), indium tin oxide (ITO), indium zinc oxide (IZO), and fluorine-doped tin oxide (FTO); an electric conductive polymer, such as electric conductive polyaniline, electric conductive polypyrrole, electric conductive polythiophene, poly (3,4-ethylenedioxythiophene) doped with polystyrene sulfonic acid; and carbon. These may be used independently, or in combination.

A shape of the electrode is appropriately selected depending on the intended purpose without any limitation, but it is preferably a shape that is typically used.

A formation method of the electrode is appropriately selected depending on the intended purpose without any limitation, and examples thereof include photoresist lithography, inkjet printing, vapor deposition, sputtering, and printing.

The electrodes are located on the insulating layer so that each electrode is separated from one another with a certain space, and form an electrode pattern.

The space (pitch) between the electrodes indicates the minimum distance between centers of two adjacent electrodes, and is preferably 85 μm to 500 μm. The width of the electrode is preferably 90 μm to 250 μm.

The average thickness of the electrode is appropriately selected depending on the intended purpose without any limitation, but it is preferably 20 nm to 1 μm, more preferably 50 nm to 300 nm.

An alignment of the electrode pattern is appropriately selected depending on the intended purpose without any limitation, and examples thereof include a grid pattern.

<Surface Layer>

The surface layer covers the electrode on the insulating layer, is desired to have functions for preventing leaking to the toner, or charging the toner to the appropriate degree by the frictional electrification with the toner. Moreover, the surface layer is desired to have a function for suppressing abrasion thereof to give high durability to maintain the aforementioned functions over a long period.

In order to achieve the aforementioned functions over a long period, the surface layer contains a crosslink reaction product of a fluororesin, or a crosslink reaction product of a (meth)acrylate compound, or both thereof, and may further contain other components, if necessary.

Note that the surface layer containing the crosslink reaction product of the fluororesin, and/or the crosslink reaction product of the (meth)acrylate compound can be confirmed by analyzing the crosslink structure, contained elements, functional groups, or the like by FT-IR, or XPS, to thereby show the presence of the crosslink reaction product in the surface layer.

<<Crosslink Reaction Product of Fluororesin>>

The crosslink reaction product of the fluororesin contains a fluororesin, may further contain a curing agent, and appropriately selected other components, if necessary.

—Fluororesin—

The fluororesin is preferably a copolymer containing a structural unit derived from fluoroethylene, and a structural unit derived from a vinyl ether group.

The copolymer can be obtained by copolymerizing a structural unit derived from fluoroethylene with a structural unit derived from a vinyl ether group.

Examples of a monomer for forming the structural unit derived from fluoroethylene include tetrafluoroethylene, and chlorotrifluoroethylene.

A proportion of the structural unit derived from fluoroethylene in the copolymer is appropriately selected depending on the intended purpose without any limitation, but it is preferably 30 mol % or greater, more preferably 40 mol % or greater. The upper limit thereof is preferably 70 mol % or less.

Examples of a monomer for forming the structural unit derived from a vinyl ether group include: cycloalkyl vinyl ether, such as cyclohexyl vinyl ether; alkyl vinyl ether, such as ethyl vinyl ether, n-propyl vinyl ether, i-propyl vinyl ether, n-butyl vinyl ether, i-butyl vinyl ether, t-butyl vinyl ether, hexyl vinyl ether, 2-ethylhexyl vinyl ether, nonyl vinyl ether, fluoroalkyl vinyl ether, and perfluoro(alkyl vinyl ether); and hydroxyalkyl vinyl ether, such as 2-hydroxyethyl vinyl ether, 3-hydroxypropyl vinyl ether, 2-hydroxypropyl vinyl ether, 4-hydroxybutyl vinyl ether, 3-hydroxybutyl vinyl ether, 5-hydroxypentyl vinyl ether, 6-hydroxyhexyl vinyl ether, and cyclohexanediol monovinyl ether. These may be used independently, or in combination.

Among them, a monomer containing the structural unit containing a vinyl ether group that contains a hydroxyl group is preferable, and a monomer containing hydroxylalkyl vinyl ether is particularly preferable, as a crosslink reaction thereof can be induced with a curing agent, and capable of forming a surface layer having excellent abrasion resistance.

For the production of the copolymer, a monomer other than the monomer containing the structural unit derived from fluoroethylene and the monomer containing the structural unit derived from a vinyl ether group can be used, and such monomer appropriately selected depending on the intended purpose without any limitation, provided that it contains a structural unit having a polymerizable double bond. Examples of such monomer include vinyl ester, allyl ether, allyl ester, isopropenyl ether, isopropenyl ester, methallyl ether, methallyl ester, α-olefin, acrylic acid ester, and methacrylic acid ester.

Examples of the vinyl ester include fatty acid vinyl ester such as vinyl butyrate, vinyl acetate, vinyl pivalate, and vinyl versatate.

Examples of the allyl ether include alkyl allyl ether, such as ethyl allyl ether, and cyclohexyl allyl ether.

Examples of the allyl ester include fatty acid allyl ester, such as allyl pripionate, and allyl acetate.

Examples of the isopropenyl ether include alkyl isopropenyl ether, such as methyl isopropenyl ether.

Examples of the α-olefin include ethylene, propylene, and isobutylene.

As for the fluororesin, for example, an alternating copolymer of a structural unit derived from fluoroethylene and a structural unit derived from a vinyl ether group, which is represented by the following general formula (1), is preferable.

Moreover, the fluororesin has excellent insulating properties, and therefore is suitable as a covering material for preventing leaking of the electrode.

The fluororesin may be appropriately synthesized, or selected from commercial products.

A synthesis method of the fluororesin is not particularly limited, and a conventional polymerization method (e.g., solution polymerization, precipitation polymerization, suspension polymerization, bulk polymerization, and emulsification polymerization) can be employed. Examples thereof include methods disclosed in Teiji Tsuruta, "synthesis method of polymer" revised edition, published by Nikkan Kogyo News Paper Pub., 1971, and Takayuki Otsu, Masayoshi Kinoshita, "Experiment method for polymer synthesis" Kagaku-Dojin Publishing Company, Inc., 1972, pp. 124 to 154).

In the case where polymerization is carried out in accordance with solution polymerization using a radical polymerization initiator, examples of a solvent for use include ethyl acetate, butyl acetate, acetone, methyl ethyl ketone, methyl isobutyl ketone, cyclohexanone, tetrahydrofuran, dioxane, N,N-dimethyl formamide, N,N-dimethyl acetamide, benzene, toluene, acetonitrile, methylene chloride, chloroform, dichloroethane, methanol, ethanol, 1-propanol, 2-propanol, and 1-butanol.

A reaction liquid is prepared by adding the solvent in an amount of about 5% by mass to about 70% by mass, preferably 10% by mass to 60% by mass, relative to a total, amount of the reaction liquid. A radical polymerization initiator is further added to the reaction liquid. A reaction is typically carried out at reaction temperature of about 50° C. to about 100° C., under reaction pressure of about 1 kg/cm$^2$ to about 30 kg/cm$^2$, for reaction time of about 1 hour to about 30 hours.

Examples of the radical polymerization initiator for use in the polymerization reaction include: an ainitiator, such as 2,2'-azobis(isobutyronitrile), 2,2'-azobis(2,4-dimethylvaleronitrile), 2,2'-azobis(2-amidinopropane)dihydrochloride, 4,4'-azobis(4-cyanopentanoic acid); and other initiators such as lauroyl peroxide, benzoyl peroxide, t-butyl peroxypivalate, General Formula (1)

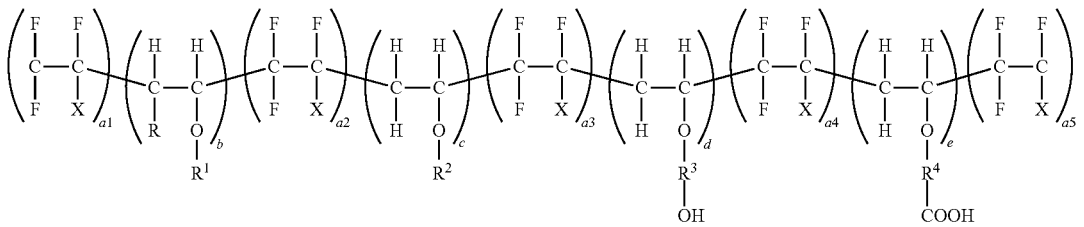

In the general formula (1), X is a fluorine atom or chlorine atom; R, $R^1$, and $R^2$ are each an alkyl group; and $R^3$ and $R^4$ are each an alkylene group.

In the general formula (1), a1 to a5, b, c, d, and e each represent a molar ratio each structural unit; a1 to a5, b, c, and d are each 1 mol % or greater, and e is 0 mol % or greater.

The fluororesin formed of the copolymer obtained by copolymerizing the structural unit derived from fluoroethylene and the structural unit derived from a vinyl ether group can be dissolved in an organic solvent, as the fluororesin contains the structural unit derived from a vinyl ether group, and can easily form a surface layer on the insulating layer and a plurality of the electrodes by a common coating method.

t-butyl peroxybenzoate, t-butyl peroxy-2-ethylhexanoate, acetyl peroxide, di-t-butylperoxide, dicumyl peroxide, cumene hydroperoxide, methyl ethyl ketone peroxide, diisopropyl perxoycarbonate, t-butyl hydroperoxide, and pottasium persulfate. An amount of the radical polymerization initiator is appropriately selected depending on the intended purpose without any limitation, but it is preferably 0.01% by mass to 10.0% by mass, relative to a total amount of the entire monomer components.

The fluororesin may be appropriately prepared by polymerization as described above, or may be selected from commercial products. Examples of a commercial product thereof include LUMIFLON LF-100, LUMIFLON LF-200, LUMIFLON LF-200MEK, LUMIFLON LF-200F, LUMIFLON LF-302, LUMIFLON LF-400, LUMIFLON LF-600, LUMIFLON LF-600X, LUMIFLON LF-800, LUMIFLON LF-906N, LUMIFLON LF-910N, LUMIFLON LF-916N, LUMIFLON LF-916F, LUMIFLON LF-936, and LUMIFLON LF-9010 (all manufactured by ASAHI GLASS CO., LTD., each of which is an alternating copolymer with a structural unit derived from fluoroethylene, and a structural unit derived from a vinyl ether group, represented by the general formula (1). These may be used independently, or in combination. Among them, LUMIFLON LF-906N, LUMIFLON LF-9010, and LUMIFLON LF-916F are particularly preferable in view of abrasion resistance, easiness for forming a thin film, and high accuracy in film thickness.

The weight average molecular weight Mw of the fluororesin is preferably 1,000 to 50,000, more preferably 3,000 to 30,000.

The hydroxyl value of the fluororesin is preferably 80 mgKOH/g or greater, more preferably 100 mgKOH/g to 200 mgKOH/g. The fluororesin having the hydroxyl value of 80 mgKOH/g or greater can realize formation of a dense crosslink network after being cured by a curing agent, and hence can form a surface layer having excellent abrasion resistance.

The hydroxyl value can be measured in accordance with JIS K0070-1966.

—Curing Agent—

The crosslink reaction product of the foluororesin preferably contains a curing agent as a component thereof.

The curing agent is appropriately selected depending on the intended purpose without any limitation, provided that it can crosslink the fluororesin, and examples thereof include an isocyanate compound.

Examples of the isocyanate compound include a polyvalent isocyanate compound, which cures a fluororesin containing polyol, and a block-type isocyanate compound, in which the aforementioned polyvalent isocyanate compound is protected with a blocking agent so as not to proceed to a crosslink reaction at room temperature.

The polyvalent isocyanate compound is a compound having two or more isocyanate groups, and may be a modified product or multimer of a compound having two or more isocyanate groups.

Examples of the polyvalent isocyanate compound include: an aliphatic polyvalent isocyanate compound, such as ethylene diisocyanate, propylene diisocyanate, tetramethylene diisocyanate, hexamethylene diisocyanate, hexamethylene triisocyanate, and lisyne diisocyanate; an alicyclic polyvalent isocyanate compound, such as isophorone diisocyanate, dicyclohexyl methane diisocyanate, and diisocyanate methyl cyclohexane; and a non-yellowing aromatic isocyanate compound, such as m-xylene diisocyanate, and p-xylene diisocyanate.

The isocyanate compound used as the curing agent may be appropriately synthesized for use, or selected from commercial products.

Examples of a commercial product of the isocyanate compound include: DURANATE THA-100, DURANATE TPA-100, DURANATE TSS-100, DURANATE TSE-100, DURANATE TSR-100, DURANATE TPA-R80X, DURANATE TPA-B80E, DURANATE 17B-60PX, and DURANATE E402-B8OT (all manufactured by Asahi Kasei Chemicals Corporation); SUMIDUR N3300, DESMODUR BL-3175, and DESMODUR BL4265 (all manufactured by Sumika Bayer Urethane Co., Ltd.); TAKENATE D-177N, TAKENATE D-173N, and TAKENATE D-140N (all manufactured by Mitsui Chemicals, Inc. (previously Mitsui Takeda Chemical)); and CORONATE HX (manufactured by Nippon Polyurethane Industry Co., Ltd.). These may be used independently, or in combination. Among them, a block-type isocyanate compound is preferable, and DURANATE TPA-R80X, TPA-B80E, 17B-60PX, E402-B8OT (manufactured by Asahi Kasei Chemicals Corporation), and DESMODUR BL-3175, BL4265 (manufactured by Sumika Bayer Urethane Co., Ltd.) are particularly preferable, in view of improved storage stability of a surface layer coating liquid at room temperature.

An amount of the curing agent can be appropriately determined depending on the hydroxyl value of the fluororesin and a NCO group content of the curing agent. Typically, a preferred formulation ratio is that the NCO group content is larger than the hydroxyl group content by 0% by mass to 10% by mass, so as not to leave unreacted hydroxyl groups of a fluororesin.

—Other Components—

Examples of other components include: additives, such as various plasticizers, and leveling agents; and a solvent.

In the case where a fluororesin is used for forming a surface layer, the surface layer can be formed by preparing a surface layer coating liquid using the fluororesin and the curing agent with a solvent such as methyl ethyl ketone, and cyclohexanone, and applying the surface layer coating liquid by a commonly used coating method (e.g., dip coating, and spray coating).

<<Crosslink Reaction Product of (Meth)Acrylate Compound>>

The crosslink reaction product of a (meth)acrylate compound contains a (meth)acrylate compound as a component thereof, and may further contain a polymerization initiator, and appropriately selected other components, if necessary.

—(Meth)Acrylate Compound—

The (meth)acrylate compound is appropriately selected depending on the intended purpose without any limitation, but it preferably contains a (meth)acrylate compound containing trifunctional or higher radical polymerizable functional groups (may also referred to as "trifunctional or higher radical polymerizable (meth)acrylate compound" hereinafter). These may be used independently, or in combination.

The trifunctional or higher radical polymerizable functional group in the trifunctional or higher radical polymerizable (meth)acrylate compound may be any group, provided that it has a carbon double bond (C═C), and is a trifunctional or higher radically polymerizable functional group (radical polymerizable functional group).

Examples of the radical polymerizable functional group include the following 1-substituted ethylene functional group, and 1,1-substituted ethylene functional group.

(1) As for the 1-substituted ethylene functional group, for example, a functional group represented by the following general formula (2) is is preferable.

$$CH_2{=}CH{-}X^1{-} \qquad \text{General Formula (2)}$$

In the general formula (2), $X^1$ is an arylene group (e.g., a phenylene group, and a naphthylene group) that may contain a substituent, an alkenylene group that may contain a substituent, —CO— group, —COO— group, —CON($R^{10}$)-group (where $R^{10}$ is a hydrogen atom, an alkyl group (e.g., a methyl group, and an ethyl group), an aralkyl group (e.g., a benzyl group, a naphthylmethyl group, and a phenethyl group or an aryl group (e.g., a phenyl group, and a naphthyl group)), or —S— group.

Examples of the substituent include a vinyl group, a styryl group, 2-methyl-1,3-butadienyl group, a vinyl carbonyl group, an acryloyloxy group, an acryloyl amide group, and a vinyl thio ether group.

(2) As for the 1,1-substituted ethylene functional group, for example, a functional group represented by the following general formula (3) is preferable.

$$CH_2{=}C(Y){-}X^2{-} \qquad \text{General Formula (3)}$$

In the general formula (3), Y is an alkyl group that may contain a substituent, an aralkyl group that may contain a substituent, an aryl group (e.g., a phenyl group, and a naphthyl group) that may contain a substituent, a halogen atom, a cyano group, a nitro group, an alkoxy group (e.g., a methoxy group, and an ethoxy group), —$COOR^{11}$ group (where $R^{11}$ is a hydrogen atom, an alkyl group (e.g., a methyl group, and an ethyl group) that may contain a substituent, an aralkyl group (e.g., a benzyl group, and a phenethyl group) that may contain a substituent, an aryl group (e.g., a phenyl group, and a naphthyl group) that may contain a substituent), or —$CONR^{12}R^{13}$ (where $R^{12}$ and $R^{13}$ are each a hydrogen atom, an alkyl group (e.g., a methyl group, and an ethyl group) that may contain a substituent, an aralkyl group (e.g., a benzyl group, a naphthyl methyl group, and a phenethyl group) that may contain a substituent, or an aryl group (e.g., a phenyl group, and a naphthyl group) that may contain a substituent), and $R^{12}$ and $R^{13}$ may be the same or different from each other); and $X^2$ is the same substituent, single bond, or alkylene group of $X^1$ of the general formula (2).

Note that, at least either Y or $X^2$ is an oxycarbonyl group, a cyano group, an alkenylene group, or an aromatic ring.

Examples of these substituents include an α-acryloyloxy chloride group, a methacryloyloxy group, an α-cyanoethylene group, an α-cyanoacryloyloxy group, an α-cyanophenylene group, and a methacryloylamino group.

Examples of a substituent with which the substituent of $X^1$, $X^2$, or Y is further substituted include a halogen atom, a nitro group, a cyano group, an alkyl group (e.g., a methyl group, and an ethyl group), an alkoxy group (e.g., a methoxy group, and an ethoxy group), an aryloxy group (e.g. a phenoxy group), an aryl group (e.g., a phenyl group, and a naphthyl group), and an aralkyl group (e.g. a benzyl group, and a phenethyl group). Among these radical polymerizable functional groups, an acryloyloxy group, and methacryloyloxy group are particularly preferable.

The compound having three or more acryloyloxy groups can be obtained, for example, through an esterification reaction or transesterification of a compound having three or more hydroxyl groups per molecule thereof with acrylic acid (salt), acrylic acid halide, or acrylic acid ester. Moreover, a compound having three or more methacryloyloxy groups can, be obtained in the same manner.

Note that, radical polymerizable functional groups contained in the (meth)acrylate compound containing three or more radical polymerizable functional groups may be the same or different from each other.

The trifunctional or higher radical polymerizable (meth) acrylate compound is appropriately selected depending on the intended purpose without any limitation, and examples thereof include trimethylol propane triacrylate (TMPTA), trimethylol propane trimethacrylate, trimethylol propane alkylene modified triacrylate, trimethylol propane ethyleneoxy modified (referred to as EO-modified hereinafter) triacrylate, trimethylol propane propyleneoxy modified (referred to as PO-modified hereinafter) triacrylate, trimethylol propane capractone modified triacrylate, trimethylol propane alkylene modified trimethacrylate, pentaerythritol triacrylate, pentaerythritol tetraacrylate (PETTA), glycerol triacrylate, glycerol epichlorohydrin modified (referred to as ECH-modified hereinafter) triacrylate, glycerol EO-modified triacrylate, glycerol PO-modified triacrylate, tris(acryloxyethyl) isocyanurate, dipentaerythritol hexaacrylate (DPHA), dipentaerythritol caplactone modified hexaacrylate, dipentaerythritol pentaacrylate, dipentaerythritol hydroxypentaacrylate, alkylated dipentaerythritol pentaacrylate, alkylated dipentaerythritol tetraacrylate, alkylated dipentaerythritol triacrylate, dimethylol propane tetraacrylate (DTMPTA), pentaerythritol ethoxytetraacrylate, phosphoric acid EO-modified triacrylate, and 2,2,5,5-tetrahydroxymethyl cyclopentanone tetraacrylate. These may be used independently, or in combination.

The trifunctional or higher radical polymerizable (meth) acrylate compound may be selected from commercial products, and examples of a commercial product thereof include KAYARAD TMPTA, KAYARAD DPCA120, KAYARAD DPHA, KAYARAD D310, and KAYARAD DPCA20 (all manufactured by Nippon Kayaku Co., Ltd.). These may be used independently, or in combination.

As for the trifunctional or higher radical polymerizable (meth)acrylate compound, a ratio of a molecular weight of the trifunctional or higher radical polymerizable (meth)acrylate compound to a number of functional groups therein (molecular weight/number of functional group) is preferably 250 or smaller, in order to densely form crosslinks in the surface layer. When the ratio of the molecular weight of the trifunctional or higher radical polymerizable (meth)acrylate compound to the number of functional groups therein is greater than 250, a surface layer is soft, and abrasion resistance thereof reduces to some extent. Therefore, among the above-listed trifunctional or higher radical polymerizable (meth) acrylate compounds, a single use of an extremely long modified group is not preferable in case of the compound having a modified group, such as EO, PO, caprolactone.

An amount of the (meth)acrylate compound used in the surface layer is preferably 20% by mass to 100% by mass, relative to a total amount of the surface layer. When the amount thereof is less than 20% by mass, a three-dimensional crosslink density of a resulting surface layer is low, and therefore it may not achieve improvement in abrasion resistance.

The surface layer contains a crosslink reaction product prepared by curing a (meth)acrylate compound, especially a trifunctional or higher radical polymerizable (meth)acrylate compound. Other than such compound, a monofunctional or bifunctional radical polymerizable (meth)acrylate monomer, a radical polymerizable (meth)acrylate oligomer, or functional monomer may be used in combination for the purpose of imparting functions, such as adjustment of viscosity for coating, stress relaxation of a surface layer, and reduction in surface energy or friction.

Examples of the monofunctional radical polymerizable (meth)acrylate monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and styrene monomer.

Examples of the bifunctional radical polymerizable (meth) acrylate monomer include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, bisphenol A-EO modified diacrylate, bisphenol F-EO modified diacrylate, and neopentyl glycol diacrylate.

Examples of the functional monomer include: those substituted with a fluorine atom, such as octafluoropentyl acrylate, 2-perfluorooctylethyl acrylate, 2-perfluorooctylethylmethacrylate, and 2-perfluoroisononylethyl acrylate; and a vinyl monomer, acrylate, and methacrylate having a polysiloxane group (e.g., siloxane repeating units disclosed in JP-A Nos. 05-60503, and 06-45770, 20 to 70 of acryloyl polydimethyl siloxane ethyl, methacryloyl polydimethyl siloxane ethyl, acryloyl polydimethylsiloxane propyl, acryloyl polydimethylsiloxane butyl, and diacryloyl polydimethylsiloxane diethyl).

Examples of the radical polymerizable (meth)acrylate oligomer include an epoxy acrylate oligomer, a urethane acrylate oligomer, and a polyester acrylate oligomer.

A total amount of the monofunctional and bifunctional radical polymerizable (meth)acrylate monomer, and the radical polymerizable (meth)acrylate oligomers is preferably 50 parts by mass or smaller, more preferably 30 parts by mass or smaller, relative to 100 parts by mass of the trifunctional or higher radical polymerizable (meth)acrylate compound. When the amount thereof is greater than 50 parts by mass, the three-dimensional crosslink density of the surface layer is substantially reduced, and therefore abrasion resistance may be lowered.

—Polymerization Initiator—

The surface layer is a cured product of the trifunctional or higher radical polymerizable (meth)acrylate compound. The surface layer preferably further contains a polymerization initiator for efficiently carrying out a crosslink reaction.

Examples of the polymerization initiator include a thermal polymerization initiator, and a photo polymerization initiator. These polymerization initiators may be used independently, or in combination as a mixture.

The thermal polymerization initiator is appropriately selected depending on the intended purpose without any limitation, and examples thereof include: a peroxide initiator, such as 2,5-dimethylhexane-2,5-dihydroperoxide, dicumylperoxide, benzoylperoxide, t-butylcumylperoxide, 2,5-dimethyl-2,5-di(peroxybenzoyl)hexine-3, di-t-butylperoxide, t-butylhydroperoxide, cumene hydroperoxide, lauroyl peroxide, 2,2-bis(4,4-di-t-butylperoxycyclohexy)propane; and an ainitiator, such as azobis(isobutyl nitrile), azobis(cyclohexane carbonitrile), azobis(methyl isobutyrate), azobis(isobutylamidine hydrochloride), and 4,4'-azobis-4-cyanovaleric acid.

The photopolymerization initiator is appropriately selected depending on the intended purpose without any limitation, and examples thereof include: an acetophenone or ketal photopolymerization initiator, such as diethoxy acetophenone, 2,2-dimethoxy-1,2-diphenylethan-1-one, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenylpropan-1-one, 2-methyl-2-morpholino(4-methylthiophenyl)propan-1-one, 1-phenyl-1,2-propanedione-2-(o-ethoxycarbonyl)oxime; a benzoin ether photopolymerization initiator, such as benzoin, benzoin methyl ether, benzoin ethyl ether, benzoin isobutyl ether, and benzoin isopropyl ether; a benzophenone photopolymerization initiator, such as benzophenone, 4-hydroxybenzophenone, o-benzoyl methyl benzoate, 2-benzoyl naphthalene, 4-benzoylbiphenyl, 4-benzoyl phenyl ether, acrylated benzophenone, and 1,4-benzoyl benzene; a thioxanthone photopolymerization initiator, such as 2-isopropylthioxanthone, 2-chlorothioxanthone, 2,4-dimethylthioxanthone, 2,4-diethylthioxanthone, 2,4-dichlorothioxanthone: and others such as ethyl anthraquinone, 2,4,6-trimethylhenzoyldiphenyl phosphine oxide, 2,4,6-trimethylbenzoylphenylethoxy phosphine oxide, bis(2,4,6-trimethylbenzoyl)phenyl phosphine oxide, bis(2,4-dimethoxybenzoyl)-2,4,4-trismethylpentyl phosphine oxide, methylphenylglyoxy ester, 9,10-phenanthrene, an acridine compound, a triadine compound, and an imidazole compound.

Note that, a compound having a photopolymerization acceleration effect may be used solely or in combination with the aforementioned photopolymerization initiator, and examples of such compound include triethanol amine, methyl diethanol amine, 4-dimethylamino ethyl benzoate, 4-dimethylaminoisoamyl benzoate, (2-dimethylamino)ethyl benzoate, and 4,4'-dimethylaminobenzophenone.

An amount of the polymerization initiator is preferably 0.5 parts by mass to 40 parts by mass, more preferably 1 part by mass to 20 parts by mass, relative to 100 parts by mass of the total amount of radical polymerizable compounds.

—Other Components—

The surface layer may optionally contain additives, such as various plasticizers and leveling agents, for the purpose of reducing pressure or proving adhesion.

As for the plasticizer, for example, those used for common resins, such as dibutyl phthalate, and dioctyl phthalate, can be used.

An amount of the plasticizer in the surface layer is preferably 20% by mass or less, more preferably 10% by mass or less.

Examples of the leveling agent include: silicone oil, such as dimethyl silicone oil, and methylphenyl silicone oil; polydimethylsilozane containing a polyester-modified acryl group; and polymers or oligomers having a perfluoroalkyl group at a side chain thereof. In the case where the leveling agent contains a reactive group, the crosslink reaction product of the (meth)acrylate compound contains the leveling agent as a component thereof.

An amount of the leveling agent in the surface layer is preferably 3% by mass or less.

In the case where the (meth)acrylate compound is used for forming a surface layer, the surface layer can be formed by applying a surface layer coating liquid containing at least a (meth)acrylate compound, and a polymerization initiator, and curing the surface layer coating liquid.

In the case where the (meth)acrylate compound is liquid, the surface layer coating liquid can be prepared by dissolving other components in the (meth)acrylate compound, and can be applied at the time of use, but it is optionally diluted, and then is applied.

The solvent is appropriately selected depending on the intended purpose without any limitation, and examples thereof include: an alcohol solvent such as methanol, ethanol, propanol, and butanol; a ketone solvent such as acetone, methyl ethyl ketone, methyl isobutyl ketone, and cyclohexanone; an ester solvent such as ethyl acetate, and butyl acetate; an ether solvent such as tetrahydrofuran, dioxane, and propyl ether; a halogen solvent such as dichloromethane, dichloroethane, trichloroethane, and chlorobenzene; an aromatic solvent such as benzene, toluene, and xylene; and a cellosolve solvent such as methyl cellosolve, ethyl cellosolve, and cellosolve acetate. These may be used independently, or in combination.

A ratio of the solvent for use is preferable 3 times to 10 times the amount of a total amount of the (meth)acrylate compound.

Examples of the coating method of the surface layer coating liquid include dip coating, spray coating, bead coating, and ring coating.

After applying the surface layer coating liquid, energy is applied externally to the surface layer coating liquid to cure the surface layer coating liquid, to thereby form a surface layer. The external energy used here includes heat, light, and radioactive rays.

As for a method for applying thermal energy, the thermal energy is applied by heating the coating surface side, or support side using gas (e.g., air and nitrogen), steam, various heat medium, IR rays, electromagnetic waves.

The heating temperature preferably 100° C. to 170° C. When the heating temperature is lower than 100° C. the reaction speed is slow, and therefore a curing reaction may not be fully completed. When the heating temperature is higher than 170° C., a curing reaction progresses unevenly due to high heating temperature, and therefore significant distortion may be caused, a large number of unreacted residual groups, or reaction terminate ends may be left in the surface layer. In order to proceed to a curing reaction uniformly, an effective method is heating at relatively low temperature of lower than 100° C., followed by heating to 100° C. or higher to thereby complete the reaction. As for the light energy, UV radiation light source, such as a high pressure mercury vapor lamp, and metal halide lamp, having emission wavelengths mainly in the UV light region, can be used. It is also possible to select a visible light source depending on the absorption wavelengths of the radical polymerizable components or photo polymerization initiator.

The irradiance is preferably 50 mW/cm$^2$ to 1,000 mW/cm$^2$. When the irradiance is lower than 50 mW/cm$^2$, a curing reaction may take a long time. When the irradiance is greater than 1,000 mW/cm$^2$, a reaction progresses unevenly, creases may be locally formed at the surface of the surface layer, or a large number of non-reacted residual groups, or reaction termination terminals may be generated. Moreover, internal stress increases as a result of drastic crosslink, which may cause cracking or peeling of a film. As for energy of the radioactive rays, those using electron beams may be included. Among them, those using thermal and optical energy are effective because it is easy to control a reaction speed, and a device for use is simple.

Regarding to the curing conditions of the surface layer, low energy for heating or light irradiation leaves a possibility that curing may not be completely finished. In such case, abrasion resistance may not be sufficient. When curing is performed with extremely high energy, conversely, a curing reaction becomes uneven, which may increase non-crosslinked portions or radical terminated portion, or may result aggregates of fine cured products. In such case, abrasion resistance may not be also sufficient.

The average maximum thickness of the surface layer (the average thickness of the portion of the surface layer where no electrode is provided) is appropriately selected depending on the intended purpose without any limitation, provided that an electric field curtain of the toner can be formed on a surface of the toner bearing member, and the electrode can be prevented from being exposed to the surface of the toner bearing member, but it is preferably 0.5 μm to 50 μm, and more preferably 5 μm to 50 μm in view of stability of toner hopping.

When the maximum average thickness thereof is less than 0.5 μm, it is difficult to give insulating properties not to cause a charge leak between the internal electrode and the toner. Accordingly, the maximum average thickness thereof is preferably 0.5 μm or greater.

When the average maximum thickness thereof is greater than 50 μm, the electric field from the internal electrode is weak, and therefore it is difficult to generate electrostatic force capable of making the toner free from the surface layer and cause hopping. Accordingly, the average maximum thickness thereof is preferably 50 μm or less.

A surface of the surface layer is preferably a uniform and smooth thin film so as not to cause unevenness in the strength of toner hopping. As for the aforementioned method for forming a uniform and smooth thin film of micron order, a wet tin film forming process is preferable.

<Production Method of Toner Bearing Member>

Examples of the production method of the toner bearing member include a method in which an insulating layer, and an electrode pattern are sequentially laminated and formed on an electric conductive support formed of aluminum, and applying, by spray coating, a surface layer coating liquid on the support on which the insulating layer bearing the electrode having the predetermined electrode pattern has been already formed.

Thereafter, the surface layer coating liquid is natural dried, or dried at relatively low temperature for a short period (at 25° C. to 80° C., for 1 minute to 10 minutes), followed by applying UV rays, or heating to thereby cure the surface layer coating liquid. In case of the UV radiation, a metal halide lamp is used, and irradiance thereof is preferably 50 mW/cm$^2$ to 1,000 mW/cm$^2$. In the case where UV rays of 200 mW/cm$^2$ are applied, the surface layer coating liquid may be uniformly irradiated by a plurality of lamps from the circumferential direction of the drum for about 30 second at the time of curing. During this operation, the temperature of the drum is controlled so as not to exceed 50° C.

In case of thermal curing, the heating temperature is preferably 100° C. to 170° C., and for example, a blast oven is used as the heating unit. In the case where the heating temperature is set to 150° C., the heating time is 20 minutes to 3 hours. After curing completely, the surface layer further heated at 100° C. to 150° C. for 10 minutes to 30 minutes for reducing solvent residuals, to thereby produce a toner bearing member.

(Developing Device)

The developing device of the present invention contains the toner bearing member of the present invention, a toner supply unit, and voltage application unit, and may further contain other members, if necessary.

The developing device induces toner hopping utilizing electric field between a plurality of electrodes, to thereby form a toner cloud.

<Toner Supply Unit>

The toner supply unit is a unit configured to supply a toner to a surface of the toner bearing member, and examples thereof include a toner supply roller.

<Voltage Application Unit>

The voltage application unit is a unit configured to apply voltage between a plurality of the electrodes and electric conductive support so that the electric field between the electrodes and the electric conductive support is periodically reversed.

<Other Members>

As for other members, a toner regulation member configured to regulate an amount of the toner deposited on the toner bearing member, and a toner storing unit configured to store the toner.

(Image Forming Apparatus and Image Forming Method)

The image forming apparatus of the present invention contains at least an electrophotographic photoconductor, a latent electrostatic image forming unit, a developing unit, a transferring unit, and a fixing unit, and may further contain appropriately selected other units, such as diselectrification unit, cleaning unit, recycling unit, controlling unit, if necessary.

As for the developing unit, the developing device of the present invention is used.

The image forming method for use in the present invention contains at least a latent electrostatic image forming step, a developing step, a transferring step, and a fixing step, and may further contain appropriately selected other steps, such as a diselectrification step, a cleaning step, a recycling step, and a controlling step, if necessary.

<Latent Electrostatic Image Forming Step and Latent Electrostatic Image Forming Unit>

The latent electrostatic image forming step is forming a latent electrostatic image on an electrophotographic photoconductor.

As for the electrophotographic photoconductor (may be also referred to as a "photoconductor" or "latent electrostatic image bearing member" hereinafter), a material, shape, structure, and size thereof are appropriately selected from those known in the art without any limitation. As for the shape thereof, a drum shape is preferably listed. As for the material thereof, for example, an inorganic photoconductor, such as amorphous silicon, and selenium, and an organic photoconductor, such as polysilane, and phthalopolymethine are listed. Among them, amorphous silicon is preferable in view of its long service life.

Formation of the latent electrostatic image can be carried out, for example, by uniformly charging a surface of the electrophotographic photoconductor, followed by exposing to light imagewise, and can be carried out by means of the latent electrostatic image forming unit. For example, the latent electrostatic image forming unit is equipped with at least a charger configured to uniformly charge a surface of the electrophotographic photoconductor, and an exposing instrument configured to expose the surface the electrophotographic photoconductor imagewise.

The charging can be carried out, for example, by applying voltage to the surface of the electrophotographic photoconductor by the charger.

The charger is appropriately selected depending on the intended purpose without any limitation, and examples thereof include conventional contact chargers known in the art equipped with conductive or semiconductive roller, brush, film, rubber blade, or the like, and conventional non-contact charger using corona discharge such as corotron and scorotron.

The exposing can be carried out, for example, by exposing a surface of the electrophotographic photoconductor to light imagewise by means of the exposure instrument.

The exposure instrument is appropriately selected depending on the intended purpose without any limitation, provided that it can expose the charged surface of the electrophotographic photoconductor by the charging instrument to light imagewise corresponding to an image to be formed. Examples thereof include various exposure instruments, such as a reproduction optical exposing device, a rod-lens array exposing device, a laser optical exposure device, and a liquid crystal shutter optical device.

Note that, in the present invention, back light exposure may be employed, where exposure is performed imagewise from the back surface of the electrophotographic photoconductor.

<Developing Step and Developing Unit>

The developing step is developing the latent electrostatic image with the toner and/or developer to form a visible image, and can be carried out by means of the developing unit.

As for the developing unit, the developing device of the present invention can be used.

As for the toner, a conventional toner produced by a pulverization or polymerization method can be used.

<Transferring Step and Transferring Unit>

The transferring step is transferring the visible image to a recording medium. A preferable embodiment is that an intermediate transfer member is used, and the visible image is primary transferred to the intermediate transfer member, followed by secondary transferring the visible image to the recording medium. A more preferable embodiment is that as for the toner, a toner of two or more colors, preferably full-color toner is used, and a primary transferring step for transferring visible images on the intermediate transfer member to form a composite transfer image, and a secondary transferring step for transferring the composite transfer image to a recording medium are included.

The transferring can be carried out, for example, by charging the visible image on the electrophotographic photoconductor by means of a transfer charger, and can be carried out by means of the transferring unit. As for the transferring unit, preferred is an embodiment where a primary transferring unit configured to transfer visible images to the intermediate transfer member to form a composite transfer image, and secondary transferring unit configured to transfer the composite transfer image to a recording medium are included.

The intermediate transfer member is appropriately selected from conventional transfer members known in the art depending on the intended purpose without any limitation, and preferable examples thereof include a transfer belt.

The transferring unit (the primary transferring unit, secondary transferring unit) preferably contains at least a transferring instrument configured to charge and release the visible image formed on the electrophotographic photoconductor to the side of the recording medium. The number of the transferring units to be equipped may be one, or two or more.

Examples of the transfer instrument include a corona transfer instrument utilizing corona discharge, a transfer belt, a transfer roller, a pressure transfer roller, and an adhesion transfer instrument.

The recording medium is appropriately selected from conventional recording media (recording paper) known in the art without any limitation.

<Fixing Step and Fixing Unit>

The fixing step is fixing the visible image transferred on the recording medium by means of the fixing unit, and the fixing step may be performed on each color toner every time an image of each color toner is transferred to the recording medium, or the fixing step may be performed on all of color toners once at the same time, in the state where images of color toners are laminated.

The fixing unit is appropriately selected depending on the intended purpose without any limitation, and preferable examples thereof include a conventional heating and pressurizing unit. Examples of the heating and pressurizing unit include a combination of a heating roller and a pressurizing roller, and a combination of a heating roller, pressurizing roller, and an endless belt.

The heating by the heating and pressurizing unit is preferably performed at 80° C. to 200° C.

In the present invention, together with or in place of the fixing step and fixing unit, for example, a conventional optical fixing unit may be used depending on the intended purpose.

<Other Steps and Other Units>

—Diselectrification Step and Diselectrification Unit—

The diselectrification step is applying diselectrification bias to the electrophotographic photoconductor to thereby diselectrify the electrophotographic photoconductor, and can be suitably carried out by the diselectrification unit.

The diselectrification unit is appropriately selected from conventional diselectrification instruments known in the art without any limitation, provided that it can apply diselectrification bias to the electrophotographic photoconductor, and preferable examples thereof include a diselectrification lamp.

—Cleaning Step and Cleaning Unit—

The cleaning step is removing the toner remained on the electrophotographic photoconductor, and can be suitably carried out by the cleaning unit.

The cleaning unit is appropriately selected from conventional cleaners known in the art without any limitation, provided that it can remove the electrophotographic toner remained on the latent electrostatic image bearing member, and examples thereof preferably include a magnetic brush cleaner, an electrostatic brush cleaner, a magnetic roller cleaner, a blade cleaner, a brush cleaner, and a web cleaner.

—Recycling Step and Recycling Unit—

The recycling step is recycling the toner removed in the cleaning step back to the developing unit, and can be suitably carried out by the recycling unit.

The recycling unit is not particularly limited, and examples thereof include conventional transporting units.

—Controlling Step and Controlling Unit—

The controlling step is controlling each step, and can be suitably carried out by means of the controlling unit.

The controlling unit is appropriately selected depending on the intended purpose without any limitation, provided that it is capable of controlling the operations of each step. Examples thereof include devices such as a sequencer, and a computer.

Figure 2:
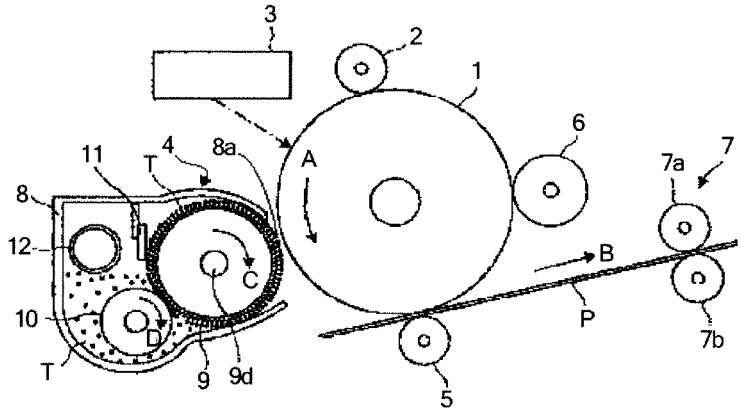
FIG. 2 is a cross-sectional view illustrating a schematic configuration of one embodiment of the image forming apparatus of the present invention.

Here, FIG. 2 is a schematic structure diagram illustrating one example of the image forming apparatus of the present invention.

In FIG. 2, "1" is a drum-shape photoconductor that rotates in the rotational direction depicted with the arrow A, and "2" is a charging roller, serving as a charging unit, and configured to uniformly charge a surface of the photoconductor 1. "3" is an exposing unit configured to apply laser light, which corresponds to image information, to the surface of the photoconductor 1. "4" is a developing device configured to supply a toner T to the latent electrostatic image formed on the surface of the photoconductor 1. "5" is a transfer roller, serving as a transferring unit, and configured to transfer a toner image formed on the surface of the photoconductor 1 by the developing device 4 onto a recording medium P, such as a transfer paper. "6" is a cleaning unit configured to remove the toner remained on the surface of the photoconductor 1 after transferring the toner image to the recording medium P. "7" is a fixing unit configured to heat and pressurize an unfixed toner image transferred on the recording medium P to thereby fix on the recording medium P.

A method for forming a toner image on a recording medium P by means of an image forming apparatus will be explained next. As illustrated in FIG. 2, certain voltage is applied to a surface of a photoconductor 1, which is rotated in the direction depicted with the arrow A, by means of a charging roller 2 to thereby uniformly charge the surface of the photoconductor 1. To the surface of the photoconductor 1, which has been uniformly charged in the aforementioned manner, laser light corresponding to predetermined image formation is applied from an exposing unit 3, to thereby form a latent electrostatic image on the surface of the photoconductor 1. Subsequently, a toner is supplied from a developing device 4 to the latent electrostatic image formed in the aforementioned manner, and electrostatically deposited on the latent electrostatic image, to thereby form a toner image. The toner image formed in the aforementioned manner is transferred from the surface of the photoconductor 1 to a surface of a recording medium P by bringing the surface of the photoconductor 1 and the recording medium P with pressure and applying bias voltage while transporting the recording medium P in the transport direction depicted with the arrow B, by means of a transfer roller 5. Thereafter, the toner image transferred on the recording medium P is fixed on the recording medium P by heating and pressurizing with a heating roller 7*a* and pressurizing roller 7*b* of a fixing unit 7. The surface of the photoconductor 1, from which the toner image has been transferred to the recording medium P in the aforementioned manner, is cleaned by removing the toner remained on the surface of the photoconductor 1 by means of a cleaning unit 6, and then again uniformly charged by means of the charging roller 2. Thereafter, a latent electrostatic image is formed by the exposing unit 3, the latent electrostatic image is developed by the developing device 4 to form a toner image, the toner image is transferred to a recording medium P by the transfer roller 5, and a surface of the photoconductor 1 is cleaned by the cleaning unit 6 in the aforementioned manner. This series of operations is repeated.

The present invention is characterized by the developing device 4, which develop, with a toner, the latent electrostatic image formed on the surface of the photoconductor 1, to thereby form a toner image. As illustrated in FIG. 2, the developing device 4 contains a toner bearing member 9 configured to supply a toner from an opening area 8*a* to a photoconductor 1, and rotatably mounted in a vessel 8 for storing the toner T, and the toner bearing member 9 is rotatably supported in the rotational direction depicted with the arrow C by means of a driving unit (not illustrated), for example, which externally applies a driving to an axial part 9*d*. Then, the toner T is supplied to a surface of the toner bearing member 9 as well as circulating the toner T to thereby charge with stirring the toner T with a circulation paddle 10. The toner bearing member 9, to which the toner T has been supplied in the aforementioned manner, scopes the toner by holding the toner T on its surface with electrostatic force, and an amount of the toner scooped is regulated by a toner regulating member 11 in the shape of a blade, which is provided to the vessel 8 so as to have a certain space with the toner bearing member 9. At the opening area 8*a* of the toner bearing member 9, as described later, alternating electric field is applied to the toner T to thereby form a cloud. As a result, the toner T is electrostatically supplied from the cloud to a latent electrostatic image on the surface of the photoconductor 1 to thereby form a toner image. Note that "12" in FIG. 2 is a toner supply roller configured to supply a supplemental toner.

Figure 3:
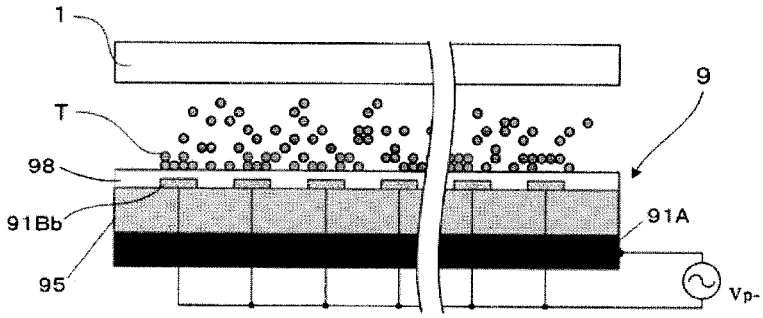
FIG. 3 is a schematic diagram for explaining a cloud state of a toner in a developing device.

Next, as illustrated in FIG. 3, the toner bearing member 9 has a laminate structure, which includes an electric conductive support 91A, an insulating layer 95, an electrode pattern 91B (electrode 91Bb), and a surface layer 98 in this order from the opposite side of the photoconductor 1.

Figure 4A:
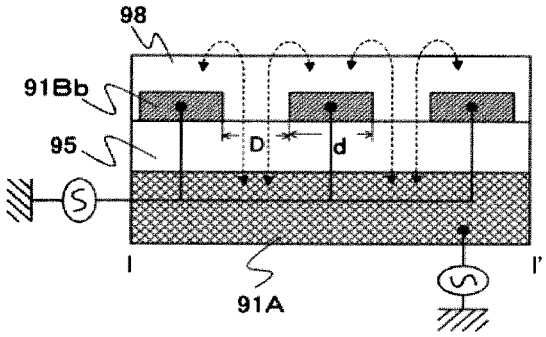
FIG. 4A is a top cross-sectional view (cross-sectional view cut at I-I' in the top view of FIG. 4B) illustrating one example of a structure of a toner bearing member.
Figure 4B:
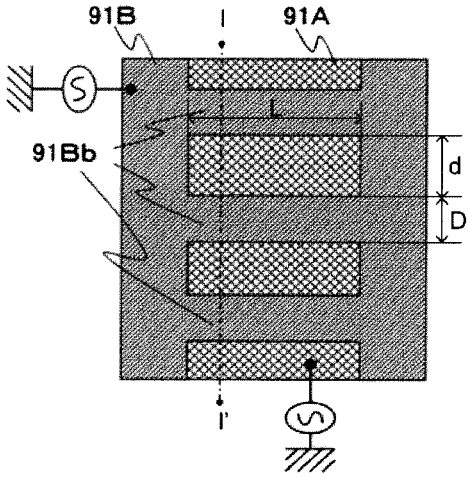
FIG. 4B is a top view illustrating one example of the structure of the toner bearing member.

As illustrated in FIGS. 4A and 4B (note that, FIG. 4A is a cross-sectional view cut at I-I' in the top view of FIG. 4B), the toner bearing member 9 contains a first electrode and a second electrode. The electric conductive support 91A functions as one of the electrodes, which is determined as an A phase, and an electrode pattern 91B having a plurality of linear electrodes 91Bb formed on the insulating layer 95 is determined as a B phase. The toner particles are hopped by the electric potential difference between the electric conductive support 91A and the electrode 91Bb, to thereby form a toner cloud. Note that, the arrow (dotted line) in FIG. 4A represents an electric field.

Note that, the electrode pattern 91B can be formed by processing a copper thin film formed, by vacuum deposition, on the peripheral surface of the cylindrically shaped electric conductive support 91A, into a desired shape by photoresist lithography. The formation method is not particularly limited, and other than patterning utilizing photoresist lithography, the electrode pattern may be formed, for example, by drawing by means of an inkjet printer. As for the electric conductive support 91A, a support formed of a material having excellent electric conductivity, such as aluminum, and aluminum alloy, may be used. Moreover, a size of the electric conductive support 91A is appropriately selected without any limitation. Further, a width d of the electrode 91Bb, and a pitch D between the electrodes 91Bb are appropriately selected without any limitation. In this embodiment, the pitch D can be made wide compared to the comb-like electrode described later. As a result, the pitch D is not formed by a defect in an electrode formation process, and therefore an electric field is not formed, which reduces a possibility that a portion where a toner hopping does not occur.

The formation of the toner cloud is influenced by the width d and pitch D of the electrode 91Bb, and alternating voltage. The width d of the electrode 91Bb is preferably 40 μm to 250 μm, the pitch D thereof is preferably 85 μm to 500 μm in order to form a desirable toner cloud. Moreover, as for the alternating voltage, preferred is voltage of 100 V to 3 kV with a frequency of 100 Hz to 5 kHz.

A material for forming the electrode 91Bb may be any material as long as it has high electric conductivity, but it is preferably in the form of a paste as an electrode can be formed by drawing an electrode pattern with such material.

Note that, alternating voltage of a single phase is used as an alternating voltage power source to the toner bearing member 9 of the present invention, but an alternating voltage power source of a phase, or a multiphase having different frequencies (with proviso that naturally a vectorial sum does not become 0) may also be used. By applying voltage to two electrodes 91Bb provided in the toner bearing member 9 so that direction of positivity and negativity is periodically reversed, the electric field of the surface of the toner bearing member 9 is periodically changed to the reverse direction. The toner T hops between the surface of the photoconductor 1 and the surface layer 98 of the toner bearing member 9 by the periodically changing electric field, to thereby form a toner cloud, from which the toner T is electrostatically attracted to a latent electrostatic image formed on the surface of the photoconductor 1, and is deposited thereon to thereby form a toner image.

Figure 5A:
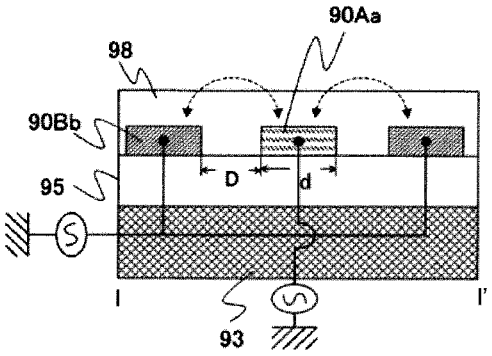
FIG. 5A is a top cross-sectional view (cross-sectional view cut at I-I' in the top view of FIG. 5B) illustrating one example of a structure of another toner bearing member.
Figure 5B:
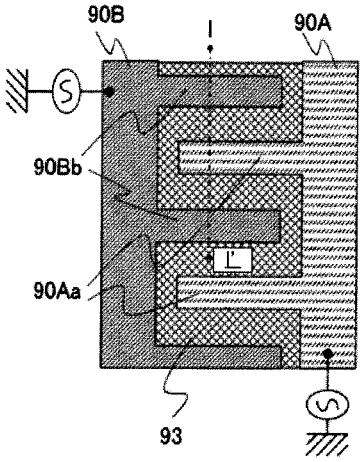
FIG. 5B is a top view illustrating one example of the structure of another toner bearing member.

The present invention attains a great effect as a result of utilization of a toner hearing member 9 of a upper and lower electrode system illustrated in FIGS. 4A and 4B, as described above, but an application of a comb-like electrode illustrated in FIGS. 5A and 5B to a toner hearing member 9 is possible, although a significantly large effect may not be attained.

Here, a toner bearing member 9 of a comb-like electrode system will be explained.

As illustrated in FIGS. 5A and 5B (note that, FIG. 5A is a cross-sectional view cut at I-I' in the top view of FIG. 5B), the toner bearing member 9 contains a first electrode pattern 90A having a plurality of linear electrodes 90Aa, and a second electrode pattern 90B having a plurality of linear electrodes 90Bb, where the electrode 90Aa and the electrodes 90Bb are alternately formed in parallel to the axial direction of the toner bearing member 9. Above these electrode patterns 90A, and 9013, an adhesive layer (not illustrated) is formed on the electrodes 90Aa, and electrodes 90Bb, and a surface layer 98 is formed to protect the electrodes 90Aa, and electrodes 90Bb. Note that, in FIG. 5A, the arrow (dotted line) represents an electric field, and the reference "95" is an insulating layer.

As for a support 93, a cylindrical insulating support formed of a synthetic resin, such as polyimide, polycarbonate, nylon, a fluororesin, polyacetal, phenol, and polystyrene, or a support in which a cylindrical metal electric conductive support, which has been produced by processing (e.g., cutting and polishing) aluminum, aluminum alloy, nickel, titanium, or stainless steel, is covered with the synthetic resin, can be used.

EXAMPLES

Examples of the present invention will be explained hereinafter, but these examples shall not be construed as limiting the scope of the present invention in any way.

<Measurement of Hydroxyl Value of Fluororesin>

A sample (0.5 g) was precisely weighted in a 100 mL measuring flask, and to the sample, 5 mL of an acetyl reagent was added accurately. Thereafter, the flask was immersed in a bath of 100° C.±5° C. to heat the mixture. One hour to two hours later, the flask was removed form the bath, and left to stand. To this, water was added, and the flask was shaken to decompose acetic anhydride. Next, in order to completely decompose, the flask was again heated in the bath for 10 minutes or longer, and left to stand. Thereafter, the wall of the flask was washed well with an organic solvent. The resulting liquid was subjected to potentetric titration with an N/2 potassium hydroxide ethyl alcohol solution, using the electrode, to thereby determine a hydroxyl value.

Example 1

Production of Toner Bearing Member

—Preparation of Insulating Coating Liquid 1—

With 75 parts by mass of methyl ethyl ketone, 190 parts of a fluororesin (LUMIFLON LF-200, manufactured by ASAHI GLASS CO., LTD.), and 35 parts of an isocyanate curing agent (TPA-B80E, manufactured by Asahi Kasei Chemicals Corporation) were mixed, to thereby prepare Insulating Coating Liquid 1.

—Preparation of Surface Layer Coating Liquid 1—

With 125 parts by mass of methyl ethyl ketone and 14 parts by is mass of cyclohexanone, 42 parts of a fluororesin (LUMIFLON LF-906N, manufactured by ASAHI GLASS CO., LTD., hydroxyl value: 118 mgKOH/g, weight average molecular weight Mw=7,000), and 20 parts by mass of an isocyanate curing agent (TPA-B80E, manufactured by Asahi Kasei Chemicals Corporation, a block-type isocyanate compound) were mixed, to thereby prepare Surface Layer Coating Liquid 1.

—Production of Toner Bearing Member—

The prepared Insulating Layer Coating Liquid 1 was applied, by dip coating, to a cylindrical aluminum (Al) support having a diameter or 16 mm, and a length of 230 mm, to thereby form an insulating layer having the average thickness of 20 μm. The resultant was used as a support to which an insulating layer had been formed.

On the support to which the insulating layer had been formed, a copper leaf film having a thickness of 0.8 μm, which was an electric conductive metal leaf film was formed by vapor deposition. Next, a resist film coating liquid (LDBL1000, manufactured by Kansai Paint Co., Ltd.) was applied onto the copper leaf film to give a thickness of 5 μm.

Light was applied to the support, to which the insulating layer covered with the copper film and the resist film had been formed, with a grid pattern that was spaced with 100 μm in width d, 200 mm in length L, and 200 μm in pitch D (see FIGS. 4A and 4B) by means of a laser drawing machine. The resultant was developed in an $Na_2CO_3$ aqueous solution, followed by etching by immersing in an $FeCl_3$ aqueous solution, to thereby form an electrode having an electrode pattern having the same pattern to the grid pattern.

Next, one side of an edge of the electrode of the support, to which the insulating layer with the electrode having the certain electrode pattern had been formed, was masked, and Surface Layer Coating Liquid 1 was applied to the support by spray coating, followed by heating at 160° C. for 60 minutes, to thereby form a surface layer having the maximum average thickness of 10 μm, and covering the electrode.

Note that, the surface layer was applied so that the electrode was exposed at the edge of the support to which the insulating layer had been formed. A toner bearing member of Example 1 was produced in the aforementioned manner.

Example 2

A toner bearing member was produced in the same manner as in Example 1, provided that in the production of Surface Layer Coating Liquid 1, the fluororesin (LUMIFLON LF-906N, manufactured by ASAHI GLASS CO., LTD., hydroxyl value: 118 mgKOH/g) was replaced with a fluororesin (LUMIFLON LF-9010, manufactured by ASAHI GLASS CO., LTD., hydroxyl value: 114 mgKOH/g).

Example 3

A toner bearing member was produced in the same manner as in is Example 1, provided that Surface Layer Coating Liquid 1 was replaced with Surface Layer Coating Liquid 2 produced in the following manner.

—Preparation of Surface Layer Coating Liquid 2—

A fluororesin (LUMIFLON LF-916F, manufactured by ASAHI GLASS CO., LTD., hydroxyl value: 100 mgKOH/g, number average molecular weight Mn=7,000; trifluorochloroethylene/4-hydroxybutyl vinyl ether/ethyl vinyl ether/cyclohexyl vinyl ether copolymer) (25 parts by mass), and 16 parts by mass of an isocyanate curing agent (a block type isocyanate compound, TPA-B80E, manufactured by Asahi Kasei Chemicals Corporation) were mixed with 145 parts by mass of methyl ethyl ketone, and 16 parts by mass of cyclohexanone, to thereby prepare Surface Layer Coating Liquid 2.

Example 4

A toner bearing member was produced in the same manner as in Example 1, provided that Surface Layer Coating Liquid 1 was replaced with Surface Layer Coating Liquid 3 prepared in the following manner.

—Preparation of Surface Layer Coating Liquid 3—

A fluororesin (LUMIFLON LF-200MEK, manufactured by ASAHI GLASS CO., LTD., hydroxyl value: 52 mgKOH/g) (56 parts by mass), and 10 parts by mass of an isocyanate curing agent (a block type isocyanate compound, TPA-B80E, manufactured by Asahi Kasei Chemicals Corporation) were mixed with 120 parts by mass of methyl ethyl ketone, and 13 parts by mass of cyclohexanone, to thereby prepare Surface Layer Coating Liquid 3.

Example 5

A toner bearing member was produced in the same manner as in Example 1, provided that Surface Layer Coating Liquid 1 was replaced with Surface Layer Coating Liquid 4 prepared in the following manner.

—Preparation of Surface Layer Coating Liquid 4—

A fluororesin (LUMIFLON LF-906N, manufactured by ASAHI GLASS CO., LTD., hydroxyl value: 118 mgKOH/g, weight average molecular weight Mw: 7,000) (49 parts by mass), and 13 parts of an isocyanate curing agent (TPA-100, manufactured by Asahi Kasei Chemicals Corporation) were mixed with 125 parts by mass of methyl ethyl ketone, and 14 parts by mass of cyclohexanone, to thereby prepare Surface Layer Coating Liquid 4.

Example 6

A toner bearing member was produced in the same manner as in Example 1, provided that Surface Layer Coating Liquid 1 was replaced with Surface Layer Coating Liquid 5 produced in the following manner, and spray coating was changed to dip coating.

—Preparation of Surface Layer Coating Liquid 5—

A fluororesin (LUMIFLON LF-906N, manufactured by ASAHI GLASS CO., LTD., hydroxyl value: 118 mgKOH/g, weight average molecular weight Mw: 7,000) (153 parts by mass), and 73 parts of an isocyanate curing agent (a block isocyanate compound, TPA-B80E, manufactured by Asahi Kasei Chemicals Corporation) were mixed with 125 parts by mass of methyl ethyl ketone, to thereby prepare Surface Layer Coating Liquid 5.

Example 7

A toner bearing member was produced in the same manner as in Example 1, provided that Surface Layer Coating Liquid 1 was replaced with Surface Layer Coating Liquid 6 produced in the following manner.

—Preparation of Surface Layer Coating Liquid 6—

A fluororesin (ZEFFLE CK-570 manufactured by DAIKIN INDUSTRIES, LTD., solid content: 65% by mass, hydroxyl value: 60 mgKOH/g) (56 parts by mass), which was formed of a copolymer of tetrafluoroethylene and a vinyl monomer, and 14 parts of an isocyanate curing agent (TPA-B80E, manufactured by Asahi Kasei Chemicals Corporation) were mixed with 127 parts by mass of methyl ethyl ketone and 14 parts by mass of cyclohexanone, to thereby prepare Surface Layer Coating Liquid 6.

Comparative Example 1

A toner bearing member was produced in the same manner as in Example 1, provided that Surface Layer Coating Liquid 1 was replaced with Surface Layer Coating Liquid A prepared in the following manner.

—Preparation of Surface Layer Coating Liquid A—

In a mixed solution of tetrahydrofuran (70 parts by mass) and cyclohexanone (30 parts by mass), 3 parts by mass of a bisphenol Z polycarbonate resin (a polymer compound composed of the following structural unit (M-15) and having a weight average molecular weight of 50,000, PANLITE TS-2050, manufactured by Teijin Chemicals Ltd.), and 0.002 parts by mass of silicone oil (KF-50, manufactured by Shin-Etsu Chemical Co., Ltd.) were dissolved, to thereby prepare Surface Layer Coating Liquid A.

(M-15)

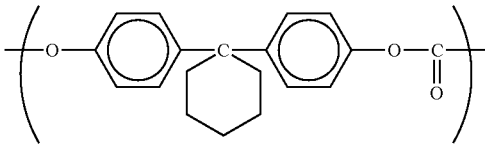

Comparative Example 2

Production of Toner Bearing Member

A toner bearing member was produced in the same manner as in Example 1, provided that Surface Layer Coating Liquid 1 was replaced with Surface Layer Coating Liquid B produced in the following manner.

—Preparation of Surface Layer Coating Liquid B—

An alkyd resin (BECKOLITE M6401-50, manufactured by DIC Corporation) (75 parts by mass), and 25 parts by mass of a melamine resin (SUPER BECKAMINE G-821-60, manufactured by DIC Corporation) were dissolved in 305 parts by mass of methyl ethyl ketone, to thereby prepare Surface Layer Coating Liquid B.

Comparative Example 3

Production of Toner Bearing Member

A toner bearing member was produced in the same manner as in Example 1, provided that Surface Layer Coating Liquid 1 was replaced with Surface Layer Coating Liquid C prepared in the following manner.

—Preparation of Surface Layer Coating Liquid C—

A silicone-acryl resin (Symac US-352, TOAGOSEI CO., LTD) (50 parts by mass), and 20 parts by mass of an isocyanate curing agent (TPA-B80E, manufactured by Asahi Kasei Chemicals Corporation) were dissolved in 230 parts by mass of 1-butanol, to thereby prepare Surface Layer Coating Liquid C.

<Conditions for Applying Voltage to Electrode>

Next, each of the produced toner bearing members was mounted in a developing device (a developing unit of imagio Neo C320, manufactured by Ricoh Company Limited), and AC bias was applied from an AC power source to a terminal provided at the opening of the developing device, and to the electric conductive support at frequency of 5 kHz, where the AC bias had peaks at −400V and 0V, and had the average potential of −200V at each moment.

Comparative Example 4

The following evaluation was performed in the same manner as in Comparative Example 1, provided that the same toner bearing member to that of Comparative Example 1 was mounted in a developing device, but voltage was not applied to the electrode.

Example 8

A toner bearing member was produced in the same manner as in Example 1, provided that in the production of the toner bearing member, a surface layer having the maximum average thickness of 10 μm, covering the electrode was formed by masking one edge on one side of the electrode pattern on the support, to which the insulating layer with the electrode having the electrode pattern in width d of 100 μm, length L of 200 mm, and pitch D of 200 μm (see FIGS. 4A and 4B) was formed, applying Surface Layer Coating Liquid 7 prepared in the following manner to the insulating layer by spray coating, irradiating at irradiance of 300 mW/cm$^2$ (with light of 365 nm), and after completely curing Surface Layer Coating Liquid 6, heating at 150° C. for 10 minutes to reduce the solvent residuals and stabilize a surface film —Preparation of Surface Layer Coating Liquid 7—

| | |
|---|---|
| Trifunctional or higher radical polymerizable monomer 1 (KAYARAD TMPTA, manufactured by Nippon Kayaku Co., Ltd.; trimethylol propane triacrylate, molecular weight: 296, number of functional groups: 3) | 1,000 parts by mass |
| Trifunctional or higher radical polymerizable monomer 2 (KAYARAD DPCA120, manufactured by Nippon Kayaku Co., Ltd.; caprolactone-modified dipentaerythritol hexaacrylate, molecular weight: 1,947, number of functional groups: 6) | 1,000 parts by mass |
| 1-hydroxy-cyclohexyl-phenylketone (IRGACURE 184, manufactured by Ciba Specialty Chemicals) as a photo polymerization initiator | 100 parts by mass |
| polydimethyl siloxane having a polyester-modified acryl group (BYT-UV3570, manufactured by BYK Japan KK) as a leveling agent | 5 parts by mass |
| 2-butanone | 8,000 parts by mass |

Example 9

A toner bearing member was produced in the same manner as in Example 8, provided that Surface Layer Coating Liquid 7 was replaced with Surface Layer Coating Liquid 8 prepared in the following manner.

—Preparation of Surface Layer Coating Liquid 8—

| | |
|---|---|
| Trifunctional or higher radical polymerizable monomer 1 (KAYARAD TMPTA, manufactured by Nippon Kayaku Co., Ltd.; trimethylol propane triacrylate, molecular weight: 296, number of functional groups: 3) | 1,000 parts by mass |
| Trifunctional or higher radical polymerizable monomer 3 (KAYARAD DPHA, manufactured by Nippon Kayaku Co., Ltd.; dipentaerythritol hexaacrylate, molecular weight: 579, number of functional groups: 6) | 1,000 parts by mass |
| 1-hydroxy-cyclohexyl-phenylketone (IRGACURE 184, manufactured by Ciba Specialty Chemicals) as a photo polymerization initiator | 100 parts by mass |
| polydimethyl siloxane having a polyester-modified acryl group (BYK-UV3570, manufactured by BYK Japan KK) as a leveling agent | 5 parts by mass |
| 2-butanone | 8,000 parts by mass |

Example 10

A toner bearing member was produced in the same manner as in Example 8, provided that Surface Layer Coating Liquid 7 was replaced with Surface Layer Coating Liquid 9 prepared in the following manner.

—Preparation of Surface Layer Coating Liquid 9—

| | |
|---|---|
| Trifunctional or higher radical polymerizable monomer 1 (KAYARAD TMPTA, manufactured by Nippon Kayaku Co., Ltd.; trimethylol propane triacrylate, molecular weight: 296, number of functional groups; 3) | 1,000 parts by mass |
| Trifunctional or higher radical polymerizable monomer 4 (KAYARAD D-310, manufactured by Nippon Kayaku Co., Ltd.; dipentaerythritol pentaacrylate, number of functional groups: 5) | 1,000 parts by mass |
| 1-hydroxy-cyclohexyl-phenylketone (IRGACURE 184, manufactured by Ciba Specialty Chemicals) as a photo polymerization initiator | 100 parts by mass |
| polydimethyl siloxane having a polyester-modified acryl group (BYK-UV3570, manufactured by BYK Japan KK) as a leveling agent | 5 parts by mass |
| 2-butanone | 8,000 parts by mass |

Example 11

A toner bearing member was produced in the same manner as in Example 8, provided that Surface Layer Coating Liquid 7 was replaced with Surface Layer Coating Liquid 10 prepared in the following manner.

—Preparation of Surface Layer Coating Liquid 10—

| | |
|---|---|
| Trifunctional or higher radical polymerizable monomer 1 (KAYARAD TMPTA, manufactured by Nippon Kayaku Co., Ltd.; trimethylol propane triacrylate, molecular weight: 296, number of functional groups: 3) | 1,000 parts by mass |
| Trifunctional or higher radical polymerizable monomer 5 (KAYARAD DPCA20, manufactured by Nippon Kayaku Co., Ltd.; caprolactone-modified dipentaerythritol hexaacrylate, molecular weight: 1,947, number of functional groups: 6) | 1,000 parts by mass |
| 1-hydroxy-cyclohexyl-phenylketone (IRGACURE 184, manufactured by Ciba Specialty Chemicals) as a photo polymerization initiator | 100 parts by mass |
| polydimethyl siloxane having a polyester-modified acryl group (BYK-UV3570, manufactured by BYK Japan KK) as a leveling agent | 5 parts by mass |
| 2-butanone | 8,000 parts by mass |

Example 12

A toner bearing member was produced in the same manner as in Example 8, provided that Surface Layer Coating Liquid 7 was replaced with Surface Layer Coating Liquid 11 produced in the following manner.

—Preparation of Surface Layer Coating Liquid 11—

| | |
|---|---|
| Trifunctional or higher radical polymerizable monomer 1 (KAYARAD TMPTA, manufactured by Nippon Kayaku Co., Ltd.; trimethylol propane triacrylate, molecular weight: 296, number of functional groups: 3) | 1,000 parts by mass |
| Trifunctional or higher radical polymerizable monomer 2 (KAYARAD DPCA120, manufactured by Nippon Kayaku Co., Ltd.; caprolactone-modified dipentaerythritol hexaacrylate, molecular weight: 1,947, number of functional groups: 6) | 1,000 parts by mass |
| 1-hydroxy-cyclohexyl-phenylketone (IRGACURE 184, manufactured by Ciba Specialty Chemicals) as a photo polymerization initiator | 100 parts by mass |
| 2-butanone | 8,000 parts by mass |

Example 13

A toner bearing member was produced in the same manner as in Example 8, provided that Insulating Layer Coating Liquid 1 was replaced with Insulating Layer Coating Liquid 2 prepared in the following manner.

—Preparation of Insulating Layer Coating Liquid 2—

| | |
|---|---|
| alkyd resin (BECKOLITE M6401-50, manufactured by DIC Corporation) | 110 parts by mass |
| melamine resin (SUPER BECKAMINE G-821-60, manufactured by DIC Corporation) | 60 parts by mass |
| methylethylketone | 110 parts by mass |

The details of the toner hearing members of Examples 1 to 13 and Comparative Examples 1 to 4 above are summarized in Table 1 below.

TABLE 1

| | Surface layer | | | | | |
|---|---|---|---|---|---|---|
| | Fluororesin | | | Curing agent | | |
| | Type | Hydroxyl value (mgKOH/g) | Amount (parts by mass) | Type | Amount (parts by mass) | Coating method |
| Ex. 1 | LUMIFLON LF-906N | 118 | 42 | TPA-B80E | 20 | Spray coating |
| Ex. 2 | LUMIFLON LF-9010 | 114 | 42 | TPA-B80E | 20 | Spray coating |
| Ex. 3 | LUMIFLON LF-916F | 100 | 25 | TPA-B80E | 16 | Spray coating |
| Ex. 4 | LUMIFLON LF-200MEK | 52 | 56 | TPA-B80E | 10 | Spray coating |
| Ex. 5 | LUMIFLON LF-906N | 118 | 49 | TPA-100 | 13 | Spray coating |
| Ex. 6 | LUMIFLON LF-906N | 118 | 153 | TPA-B80E | 73 | Dip coating |
| Ex. 7 | ZEFFLE CK-570 | 60 | 56 | TPA-B80E | 14 | Spray coating |

TABLE 1-continued

| | | |
|---|---|---|
| Comp. Ex. 1 | Example 1 of JP-A No 2010-281859 (polycarbonate resin) | Spray coating |
| Comp. Ex. 2 | Alkyd resin + Melamine resin (no curing agent) | Spray coating |
| Comp. Ex. 3 | Silicone-acryl resin (curing agent TPA-B80E) | Spray coating |
| Comp. Ex. 4 | No electric conduction in Comparative Example 1 | Spray coating |

| | Surface layer | | | Insulating layer |
|---|---|---|---|---|
| | Trifunctional or higher radical polymerizable (meth)acrylate monomer | | Leveling agent | Insulating layer coating liquid |
| Ex. 8 | KAYARAD TMPTA | KAYARAD DPCA120 | BYK-UV3570 | Insulating layer coating liquid 1 |
| Ex. 9 | KAYARAD TMPTA | KAYARAD DPHA | BYK-UV3570 | Insulating layer coating liquid 1 |
| Ex. 10 | KAYARAD TMPTA | KAYARAD D-310 | BYK-UV3570 | Insulating layer coating liquid 1 |
| Ex. 11 | KAYARAD TMPTA | KAYARAD DPCA20 | BYK-UV3570 | Insulating layer coating liquid 1 |
| Ex. 12 | KAYARAD TMPTA | KAYARAD DPCA120 | None | Insulating layer coating liquid 1 |
| Ex. 13 | KAYARAD TMPTA | KAYARAD DPCA120 | BYK-UV3570 | Insulating layer coating liquid 2 |

<Image Formation>

As for a toner, a black (BK) toner (pulverized toner containing no wax) loaded in an image forming apparatus (imagio Neo C320, manufactured by Ricoh Company Limited) was used, and supplied to a developing device.

The developing device and the toner were incorporated into a black (BK) station of the image forming apparatus (imagio Neo C320, manufactured by Ricoh Company Limited), and an image was output consecutively for 50 hours.

Next, the toner bearing members of Examples 1 to 13 and Comparative Examples 1 to 4 were evaluated in terms of toner electrostatic property, abrasion amount of the surface layer, formation of a defected image, toner hopping phenomenon, leak phenomenon, voltage resistance, and grid peeling test. The results are presented in Table 2.

<Toner Electrostatic Property>

The toner electrostatic property was represented as a value obtained by dividing, with a weight of the toner, an electric charge of the toner n an area of the toner bearing member closest to the electrophotographic photoconductor after consecutive printing of 50 hours, and was measured in accordance with a suction method. Specifically, the toner on the toner bearing member was suctioned by a vacuum pump, followed by passing through a mesh. The electric charge which the obtained toner had was measured by means of 6514 system electrometer of Keithley Instruments Inc. Based on the thickness of the toner layer on the toner bearing member, the weight of the toner in the area of the toner bearing member closest to the photoconductor was measured. The electrostatic property of the toner was determined by dividing the obtained electric charge of the toner with the weight of the toner. Note that, an acceptable range of the electrostatic property of the toner is 10 (−μC/g) to 40 (−μC/g).

<Abrasion Amount of Surface Layer>

A toner bearing member was measured, initially and after consecutive printing of 50 hours, on 18 spots each spaced from each other with 1 cm in a length direction by means of an eddy current thickness gauge (FISCHERSCOPE MMS, manufactured by Fischer), and in each case, the average thickness of the surface layer was determined from the average of the obtained values. The abrasion amount of the surface layer was represented by a reduction amount in the average thickness, which was obtained by deducting the average thickness of the surface layer after the consecutive printing of 50 hours from the average thickness of the initial surface layer.

<Formation of Defected Image>

The formation of a defected image was evaluated by measuring image density of a solid image formed after consecutive printing of 50 hours by means of a 500 series spectrodesitometer manufactured by X-RITE. The image density of 1.4 or greater was evaluated as "no defected image," and the image density of less than 1.4 gave an image of pale color because of insufficient density, and therefore was evaluated as "formation of defected image."

<Evaluation of Toner Hopping>

The toner hopping was evaluated in the following manner. A solid image was developed on a photoconductor, and the toner used developing the photoconductor was measured in accordance with a suction method with respect to a whole toner (the toner used for developing the photoconductor, and the toner remained on the toner bearing member). Determining the state where no toner was remained on the toner bearing member as 100% of toner hopping, a case when the proportion of the toner hopped on the toner bearing member was 80% or higher as evaluated as "toner hopping occurred," and a case when the proportion of the toner hopped on the toner bearing member was lower than 80% was evaluated as "no toner hopping."

<Evaluation of Leaking>

Leaking means a phenomenon that voltage is not applied because of a leak when voltage is applied to between the electrode and the core grid of the toner bearing member. Leaking occurs because insulation property of the insulating layer between the electrode and core grid of the toner bearing member is destroyed to thereby generate a low resistance area. Moreover, leaking occurs when a material having low voltage resistance is used for an insulating layer.

Specifically, electric potential of rectangular pulses was input between the electrode and core grid of the toner bearing member, and leaking was evaluated by determining whether or not the potential difference (rectangular wave) as input was maintained, using an oscilloscope (manufactured by Yokokawa Electric Corporation). "No leak" means that the rectangular wave as input is maintained. "Leak" means that the rectangular wave is disappeared immediately.

<Measurement of Voltage Resistance>

The voltage resistance was measured in the following manner. A metal thin film (a copper leaf film) with the area of 5 mm×10 mm was formed on a surface layer in the same manner as the electrode forming method in Examples and Comparative Examples, voltage was applied between the metal thin film, and the electrode pattern present between the insulating layer and the surface layer, and the voltage at which insulating properties were lost was measured as voltage resistance. An acceptable range of the voltage resistance is 1,000 V (1 kV) or greater.

<Grid Peeling Test (Adhesion)>

In accordance with a grid peeling test specified in JIS K5400, the initial toner bearing member was evaluated. A result of this grid peeling test indicates the number of squares of the grid in which the surface layer remained without being peeled out of 100 squares of the grid, and the larger value indicates the stronger adhesion of the surface layer. 5/100 or greater is an acceptable range.

TABLE 2

| | Toner charge [-μC/g] | Abrasion amount of surface layer [μm] | Output of defected image | Toner hopping | Leak | Voltage resistance [kV] | Leak test |
|---|---|---|---|---|---|---|---|
| Ex. 1 | 32.9 | 1.72 | No | Yes | No | 2.0 | 100/100 |
| Ex. 2 | 30.8 | 1.53 | No | Yes | No | 1.9 | 100/100 |
| Ex. 3 | 33.9 | 1.62 | No | Yes | No | 2.2 | 100/100 |
| Ex. 4 | 31.2 | 2.34 | No | Yes | No | 1.9 | 100/100 |
| Ex. 5 | 32.7 | 1.59 | No | Yes | No | 2.2 | 100/100 |
| Ex. 6 | 33.1 | 1.72 | No | Yes | No | 2.0 | 100/100 |
| Ex. 7 | 34.2 | 3.76 | No | Yes | No | 1.9 | 100/100 |
| Ex. 8 | 31.5 | 1.54 | No | Yes | No | 1.7 | 71/100 |
| Ex. 9 | 34.2 | 1.68 | No | Yes | No | 1.8 | 78/100 |
| Ex. 10 | 33.5 | 1.73 | No | Yes | No | 1.7 | 64/100 |
| Ex. 11 | 36.4 | 1.86 | No | Yes | No | 1.8 | 68/100 |
| Ex. 12 | 32.8 | 1.59 | No | Yes | No | 1.0 | 59/100 |
| Ex. 13 | 31.6 | 1.67 | No | Yes | No | 1.6 | 72/100 |
| Comp. Ex. 1 | 29.8 | 5.82 | No | Yes | No | 2.8 | 0/100 |
| Comp. Ex. 2 | 80.1 | 6.77 | Yes | No | No | 3.2 | 100/100 |
| Comp. Ex. 3 | 30.8 | 9.01 | Yes | No | Yes | 0.7 | 100/100 |
| Comp. Ex. 4 | 28.3 | 0.77 | Yes | No | No | 2.0 | 0/100 |

It was found from the results presented in Table 2 that no output of a defected image was found in Examples 1 to 13 and Comparative Examples 1, but the abrasion amount of the surface layer was large in Comparative Example 1.

Moreover, smoothness of the surface layer was not great in Example 12, as a leveling agent was not used in the surface layer coating liquid. As a result, there were areas in which the thickness of the surface layer was locally thin, and therefore the voltage resistance was low compared to that in Examples 8 to 11 and 13 in which the leveling agent was used.

Since the toner charging ability of the material of the surface layer of the toner bearing member was excessively high in Comparative Example 2, the toner was electrostatically gravitated to the surface of the toner bearing member. Therefore, the toner did not hop at the surface of the toner hearing member. As a result, normal image output could not be performed.

Numerous electric discharge leaks were occurred between the electrode inside the toner bearing member and the toner bearing member contact member, because of crack in the surface layer of the toner bearing member in Comparative Example 3, and therefore voltage of the electrode could not be maintained. As a result, electric field capable of inducing toner hopping could not be generated, and therefore normal image output could not be performed.

Since voltage was not applied to the electrode in Comparative Example 4, abrasion due to electric discharge did not occur, and therefore the abrasion amount of the surface layer was small. However, electric field capable of inducing toner hopping could not be generated, and therefore normal image output could not be performed.

The embodiments of the present invention are, for example, as follows:

<1> A toner bearing member, containing:

an electric conductive support;

an insulating layer provided on the electric conductive support;

a plurality of electrodes located on the insulating layer so that each electrode is separated from one another with a certain space; and a surface layer covering the insulating layer and the electrodes, wherein the surface layer contains a crosslink reaction product of a fluororesin, or a crosslink reaction product of a (meth)acrylate compound, or both thereof.

<2> The toner bearing member according to <1>, wherein the fluororesin is a copolymer containing a structural unit derived from fluoroethylene, and a structural unit derived from a vinyl ether group.

<3> The toner bearing member according to <2>, wherein the structural unit derived from a vinyl ether group contains a hydroxyl group.

<4> The toner bearing member according to <3>, wherein the fluororesin has a hydroxyl value of 80 mgKOH/g or greater.

<5> The toner bearing member according to any one of <1> to <4>, wherein the crosslink reaction product of the foluororesin further contains a curing agent as a component thereof, where the curing agent is an isocyanate compound.

<6> The toner bearing member according to <5>, wherein the isocyanate compound is a block type isocyanate compound.

<7> The toner bearing member according to any one of <1> to <6>, wherein the crosslink reaction product of the (meth) acrylate compound contains a trifunctional or higher radical polymerizable (meth)acrylate compound as a component thereof.

<8> The toner bearing member according to <7>, wherein a functional group contained in the trifunctional or higher radical polymerizable (meth)acrylate compound is a (meth)acryloyloxy group.

<9> The toner bearing ember according to any of <7> or <8>, wherein the crosslink reaction product of the (meth)acrylate compound contains a leveling agent as a component thereof.

<10> A developing device, containing:

the toner bearing member as defined in any one of <1> to <9>;

a toner supply unit configured to supply a toner to a surface of the toner bearing member; and a voltage application unit configured to apply voltage to between the electrodes and the electric conductive support so that an electric field between the electrodes and the electric conductive support periodically reverses, wherein an electric field formed between the electrodes makes the toner hop to form a toner cloud.

<11> An image forming apparatus, containing:

an electrophotographic photoconductor;

a latent electrostatic image forming unit configured to form a latent electrostatic image on the electrophotographic photoconductor;

a developing unit configured to develop the latent electrostatic image with a toner to form a visible image;

a transferring unit configured to transfer the visible image to a recording medium; and a fixing unit configured to fix the transferred visible image on the recording medium, wherein the developing unit is the developing device as defined in <10>.

This application claims priority to Japanese application No. 2011-200820, filed on Sep. 14, 2011, and incorporated herein by reference.

What is claimed is:

1. A toner bearing member, comprising:

an electric conductive support;

an insulating layer provided on the electric conductive support;

a plurality of electrodes located on the insulating layer so that each electrode is separated from one another with a certain space; and a surface layer covering the insulating layer and the electrodes, wherein the surface layer contains a crosslink reaction product of a fluororesin, or a crosslink reaction product of a (meth)acrylate compound, or both thereof.

2. The toner bearing member according to claim 1, wherein the fluororesin is a copolymer containing a structural unit derived from fluoroethylene, and a structural unit derived from a vinyl ether group.

3. The toner bearing member according to claim 2, wherein the structural unit derived from a vinyl ether group contains a hydroxyl group.

4. The toner bearing member according to claim 3, wherein the fluororesin has a hydroxyl value of 80 mgKOH/g or greater.

5. The toner bearing member according to claim 1, wherein the crosslink reaction product of the fluororesin contains a curing agent as a component thereof, where the curing agent is a block-typeisocyanate compound.

6. The toner bearing member according to claim 1, wherein the crosslink reaction product of the (meth)acrylate compound contains a trifunctional or higher radical polymerizable (meth)acrylate compound, as a component thereof.

7. The toner bearing member according to claim 6, wherein a functional group contained in the trifunctional or higher radical polymerizable (meth)acrylate compound is a (meth) acryloyloxy group.

8. The toner hearing member according to claim 7, wherein the crosslink reaction product of the (meth)acrylate compound further contains a leveling agent as a component thereof.

9. The toner bearing member according to claim 6, wherein the crosslink reaction product of the (meth)acrylate compound further contains a leveling agent as a component thereof.

10. A developing device, comprising:

a toner bearing member, where the toner bearing member contains an electric conductive support, an insulating layer provided on the electric conductive support, a plurality of electrodes located on the insulating layer so that each electrode is separated from one another with a certain space, and a surface layer covering the insulating layer and the electrodes;

a toner supply unit configured to supply a toner to a surface of the toner bearing member; and a voltage application unit configured to apply a voltage between the electrodes and the electric conductive support so that an electric field between the electrodes and the electric conductive support periodically reverses, wherein an electric field formed between the electrodes makes the toner hop to form a toner cloud, and wherein the surface layer of the toner bearing member contains a crosslink reaction product of a fluororesin, or a crosslink reaction product of a (meth)acrylate compound, or both thereof.

11. An image forming apparatus, comprising:

an electrophotographic photoconductor;

a latent electrostatic image forming unit configured to form a latent electrostatic image on the electrophotographic photoconductor;

a developing unit configured to develop the latent electrostatic image with a toner to form a visible image;

a transferring unit configured to transfer the visible image to a recording medium; and a fixing unit configured to fix the transferred visible image on the recording medium, wherein the developing unit contains:

a toner bearing member, where the toner bearing member contains an electric conductive support, an insulating layer provided on the electric conductive support, a plurality of electrodes located on the insulating layer so that each electrode is separated from one another with a certain space, and a surface layer covering the insulating layer and the electrodes;

a toner supply unit configured to supply a toner to a surface of the toner bearing member; and a voltage application unit configured to apply a voltage between the electrodes and the electric conductive support so that an electric field between the electrodes and the electric conductive support periodically reverses, wherein an electric field formed between the electrodes makes the toner hop to form a toner cloud, and wherein the surface layer of the toner bearing member contains a crosslink reaction product of a fluororesin, or a crosslink reaction product of a (meth)acrylate compound, or both thereof.

* * * * *